US010823362B2

(12) United States Patent
Chikama et al.

(10) Patent No.: US 10,823,362 B2
(45) Date of Patent: Nov. 3, 2020

(54) VEHICULAR LAMP FITTING

(71) Applicant: STANLEY ELECTRIC CO., LTD., Tokyo (JP)

(72) Inventors: Hiroyuki Chikama, Tokyo (JP); Norifumi Imazeki, Tokyo (JP); Haruna Minami, Tokyo (JP); Marino Mine, Tokyo (JP); Akihiko Hanya, Tokyo (JP); Kosaburo Ito, Tokyo (JP); Takuya Yamamoto, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/560,514

(22) Filed: Sep. 4, 2019

(65) Prior Publication Data

US 2020/0080703 A1 Mar. 12, 2020

(30) Foreign Application Priority Data

Sep. 6, 2018 (JP) ..... 2018-167135

(51) Int. Cl.

| | |
|---|---|
| ***F21S 43/14*** | (2018.01) |
| ***F21S 43/20*** | (2018.01) |
| ***F21V 5/04*** | (2006.01) |
| ***F21W 103/20*** | (2018.01) |
| ***F21W 103/35*** | (2018.01) |
| ***F21S 43/145*** | (2018.01) |

(Continued)

(52) U.S. Cl.

CPC ..... *F21S 43/14* (2018.01); *F21S 43/26* (2018.01); *F21V 5/045* (2013.01); *F21S 43/145* (2018.01); *F21S 43/15* (2018.01); *F21W 2103/20* (2018.01); *F21W 2103/35* (2018.01); *F21Y 2107/70* (2016.08)

(58) Field of Classification Search

CPC .. F21Y 2107/50; F21Y 2107/70; F21S 43/14; F21S 43/145; F21S 43/15

See application file for complete search history.

(56) References Cited

U.S. PATENT DOCUMENTS 6,520,669 B1 * 2/2003 Chen ..... B60Q 1/2696 362/545

2003/0223236 A1 12/2003 Wu (Continued)

FOREIGN PATENT DOCUMENTS

DE 10 2013 008 192 A1 11/2014

JP H11-266035 A 9/1999

(Continued)

OTHER PUBLICATIONS

The partial European Search Report for the related European Patent Application No. 19195736.4 dated Feb. 6, 2020.

*Primary Examiner* — Alexander K Garlen

(74) *Attorney, Agent, or Firm* — Kenealy Vaidya LLP

(57) ABSTRACT

A vehicular lamp fitting comprising a film light source that includes a transparent film having flexibility, and a plurality of semiconductor light-emitting elements which are fixed in a state of being two-dimensionally disposed on at least a front surface of the transparent film; and a reflection surface that is disposed in a state of facing a rear surface of the transparent film of the film light source, and that reflects light which is emitted from a part or all of the plurality of semiconductor light-emitting elements and transmitted through the transparent film.

15 Claims, 18 Drawing Sheets

(51) Int. Cl.
*F21S 43/15* (2018.01)
*F21Y 107/70* (2016.01)

(56) References Cited

U.S. PATENT DOCUMENTS

| | | | | |
|---|---|---|---|---|
| 2013/0026504 | A1* | 1/2013 | Marx | F21K 9/00 257/88 |
| 2014/0209945 | A1* | 7/2014 | Baldridge | H01L 25/0753 257/91 |
| 2014/0264396 | A1* | 9/2014 | Lowenthal | H01L 33/08 257/88 |
| 2015/0023046 | A1 | 1/2015 | Shido et al. | |
| 2015/0171059 | A1 | 6/2015 | Hu | |
| 2015/0283936 | A1 | 10/2015 | Nakamura | |
| 2015/0345740 | A1* | 12/2015 | Watanabe | F21S 43/30 362/517 |
| 2016/0218257 | A1* | 7/2016 | Ray | F21V 33/0008 |
| 2017/0016587 | A1 | 1/2017 | Iyoda | |
| 2017/0108201 | A1* | 4/2017 | Shields | F21V 21/145 |
| 2017/0254518 | A1* | 9/2017 | Vasylyev | G02B 6/0083 |
| 2017/0365945 | A1* | 12/2017 | Speer | F21V 23/06 |
| 2019/0032894 | A1* | 1/2019 | Ho | F21V 19/0025 |

FOREIGN PATENT DOCUMENTS

| | | | |
|---|---|---|---|
| JP | 2015-022917 | A | 2/2015 |
| JP | 2016-058136 | A | 4/2016 |
| JP | 2017-027661 | A | 2/2017 |
| WO | 2014/128667 | A1 | 8/2014 |

* cited by examiner

VEHICULAR LAMP FITTING

CROSS-REFERENCE TO RELATED APPLICATION

This application is based upon and claims the benefit of priority of the prior Japanese Patent Application No. 2018-167135, filed on Sep. 6, 2018, the entire contents of which are incorporated herein by reference.

FIELD

The present invention relates to a vehicular lamp fitting, and more particularly to a vehicular lamp fitting having a new light-emitting appearance, which satisfies light distribution standards specified by laws and regulations, and is capable of implementing various levels of brightness and light-emitting patterns having different light-emitting shapes (various light-emitting graphics).

BACKGROUND

A vehicular lamp fitting using an organic EL has been proposed (e.g. Japanese Patent Application Publication No. 2016-58136). Japanese Patent Application Publication No. 2016-58136 discloses a vehicular lamp fitting in which an organic EL panel which functions as a tail lamp and an organic EL panel which functions as a stop lamp are disposed side by side.

SUMMARY

However, in the vehicular lamp fitting according to Japanese Patent Application Publication No. 2016-58136, only a simple light-emitting pattern, where the organic EL panel which functions as a tail lamp and the organic EL panel which functions as the stop lamp emit light or do not emit light respectively, and with this vehicular lamp fitting, implementing a vehicular lamp fitting having a new light-emitting appearance is difficult. Further, the brightness of the organic EL panel is low at the moment, which makes it difficult to satisfy the light distribution standards specified by laws and regulations (especially in the case of the stop lamp and turn signal lamp for which high brightness is demanded) (e.g. Japanese Patent Application Publication No. 2015-22917).

With the foregoing in view, it is an object of the present invention to provide a vehicular lamp fitting having a new light-emitting appearance which satisfies light distribution standards specified by laws and regulations, and is capable of implementing various levels of brightness and light-emitting patterns having different light-emitting shapes (various light-emitting graphics).

In order to achieve the object described above, an aspect of the present invention provides a vehicular lamp fitting, comprising: a film light source that includes a transparent film having flexibility, and a plurality of semiconductor light-emitting elements which are fixed in a state of being two-dimensionally disposed on at least a front surface of the transparent film; and a reflection surface that is disposed in a state of facing a rear surface of the transparent film of the film light source, and that reflects light which is emitted from a part or all of the plurality of semiconductor light-emitting elements and transmitted through the transparent film.

According to this aspect, a vehicular lamp fitting having a new light-emitting appearance, which satisfies light distribution standards specified by laws and regulations, and is capable of implementing various levels of brightness and light-emitting patterns having different light-emitting shapes (various light-emitting graphics), can be provided.

Further, according to this aspect, a light utilization efficiency of the light that is emitted backward from the semiconductor light-emitting elements of the film light source improves. In other words, the reflection surface can emit light by the light that is emitted backward from the semiconductor light-emitting elements of the film light source. Thereby the light emitted from the reflection surface is visually recognized via the film light source (transparent film), and a three-dimensional light-emitting appearance having a perspective of depth can be implemented.

Since the semiconductor light-emitting elements of which brightness is higher than the organic EL, according to this aspect, the light distribution standards specified by laws and regulations can be satisfied (particularly in the case of a stop lamp and a turn signal lamp for which high brightness is demanded), because the semiconductor light-emitting elements of which brightness is higher than the case of organic EL is used.

In the present invention, it is preferable that the vehicular lamp fitting further includes a light distribution control lens that controls light which is emitted from a part or all of the plurality of semiconductor light-emitting elements and transmitted through the transparent film. The light distribution control lens is disposed between the film light source and the reflection surface, and the reflection surface reflects the light controlled by the light distribution control lens.

In the present invention, it is preferable that the light distribution control lens includes a plurality of lens units respectively corresponding to the plurality of semiconductor light-emitting elements. Each of the plurality of lens units controls light which is emitted from the semiconductor light-emitting element corresponding to the lens unit and transmitted through the transparent film.

In the present invention, it is preferable that each of the plurality of lens unit is a flute cut lens.

In the present invention, it is preferable that each of the plurality of lens units is a lens unit of which focal point is set in the vicinity of the semiconductor light-emitting element corresponding to the lens unit. The reflection surface reflects the light controlled by each of the plurality of lens units to a target direction.

According to these aspects, the light utilization efficiency of the light that is emitted backward from the semiconductor light-emitting elements of the film light source improves. In other words, a predetermined light distribution pattern (e.g. tail lamp light distribution pattern, stop lamp light distribution pattern) can be formed by reflecting the light radiated (emitted) backward from the film light source in a target direction using the reflected surface, in addition to the light radiated (emitted) forward from the film light source.

In the present invention, it is preferable that each of the plurality of lens units is a Fresnel lens.

In the present invention, it is preferable that the vehicular lamp fitting further includes a film light source support unit that supports the film light source in a state of the transparent film maintaining a predetermined shape. The film light source support unit includes a front lens, a rear lens, and a lens fixing unit that fixes the front lens and the rear lens, and the lens fixing unit fixes the front lens and the rear lens in a state of the film light source being disposed between the front lens and the rear lens.

In the present invention, it is preferable that the rear lens is configured as the light distribution control lens.

In the present invention, it is preferable that the light distribution control lens is disposed between the rear lens and the reflection surface.

In the present invention, it is preferable that the vehicular lamp fitting further includes: a film light source support unit that supports the film light source in a state of the transparent film maintaining a predetermined shape; and a plurality of the film light sources. The plurality of film light sources are disposed in a state of being overlapped in a longitudinal direction of the vehicle within a same range in a front view, the plurality of film light sources include at least a first film light source and a second film light source, the film light source support unit includes a front lens, an intermediate lens, a rear lens and a lens fixing unit which fixes the front lens, the intermediate lens and the rear lens, and the lens fixing unit fixes the front lens, the intermediate lens and the rear lens in a state where the first film light source is disposed between the front lens and the intermediate lens, and the second film light source is disposed between the intermediate lens and the rear lens.

In the present invention, it is preferable that the intermediate lens and the rear lens are each configured as the light distribution control lens.

In the present invention, it is preferable that the vehicular lamp fitting includes the light distribution control lenses respectively disposed between the intermediate lens and the second film light source, and between the rear lens and the reflection surface.

In the present invention, it is preferable that the vehicular lamp fitting further comprises a film light source support unit that supports the film light source in a state of the transparent film maintaining a predetermined shape; a lamp fitting unit that includes the film light source and the film light source support unit; and a lamp fitting unit support unit that is transparent supports the lamp fitting unit. The lamp fitting unit support unit supports the lamp fitting unit in a lamp chamber constituted of a housing and an outer lens in a state of maintaining a space between the lamp fitting unit and the housing.

According to these aspects, the lamp fitting unit is disposed in the lamp chamber in a state of maintaining a space between the lamp fitting unit and the housing, and the lamp fitting support unit is transparent and is difficult to be visually recognized, hence a light-emitting appearance that is visually recognized, as if the lamp fitting unit were floating in the lamp chamber, is implemented.

In the present invention, it is preferable that a vehicular lamp fitting has: a film light source that includes a transparent film having flexibility, and a plurality of semiconductor light-emitting elements which are fixed in a state of being two-dimensionally disposed on at least a front surface of the transparent film; a film light source support unit that supports the film light source in a state of the transparent film maintaining a predetermined shape; a lamp fitting unit that includes the film light source and the film light source support unit; and a lamp fitting unit support unit that is transparent and supports the lamp fitting unit. The lamp fitting unit support unit supports the lamp fitting unit in a lamp chamber constituted of a housing and an outer lens in a state of maintaining a space between the lamp fitting unit and the housing.

According to this aspect, the lamp fitting unit is disposed in the lamp chamber in a state of maintaining a space between the lamp fitting unit and the housing, and the lamp fitting support unit is transparent and is difficult to be visually recognized, hence a light-emitting appearance that is visually recognized, as if the lamp fitting unit were floating in the lamp chamber, is implemented.

In the present invention, it is preferable that the lamp fitting unit support unit is a transparent support unit of which a part is fixed to the lamp fitting unit and another part is fixed to the housing.

In the present invention, it is preferable that the lamp fitting unit is cantilever-supported by the transparent support unit.

DESCRIPTION OF EMBODIMENTS

A vehicular lamp fitting 10 according to Embodiment 1 of the present invention will be described with reference to the drawings. In each drawing, corresponding composing elements are denoted with a same reference sign, and redundant description thereof will be omitted.

Figure 1:
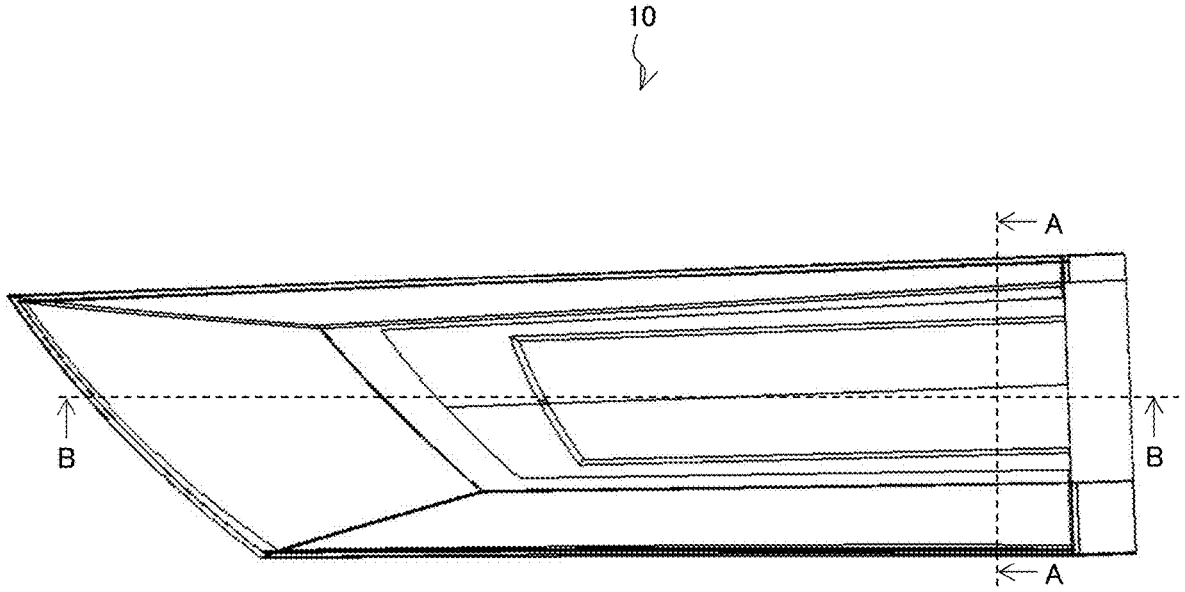
FIG. 1 is a front view of the vehicular lamp fitting 10.

FIG. 1 is a front view of the vehicular lamp fitting 10.

The vehicular lamp fitting 10 illustrated in FIG. 1 is a vehicular signal lamp fitting that functions as a tail lamp and a stop lamp, for example. The vehicular lamp fitting 10 is disposed on both the left and right sides of the rear end portion of a vehicle (e.g. automobile) respectively. The vehicular lamp fittings 10 are disposed on the left and right sides so as to be bilaterally symmetrical, hence the vehicular lamp fitting 10, which is disposed on the left side of the rear end portion of the vehicle (left side when facing the front side of the vehicle), will be described. To simplify description in the following, "front side" refers to the rear side of the vehicle, and "rear side" refers to the front side of the vehicle.

Figure 2A:
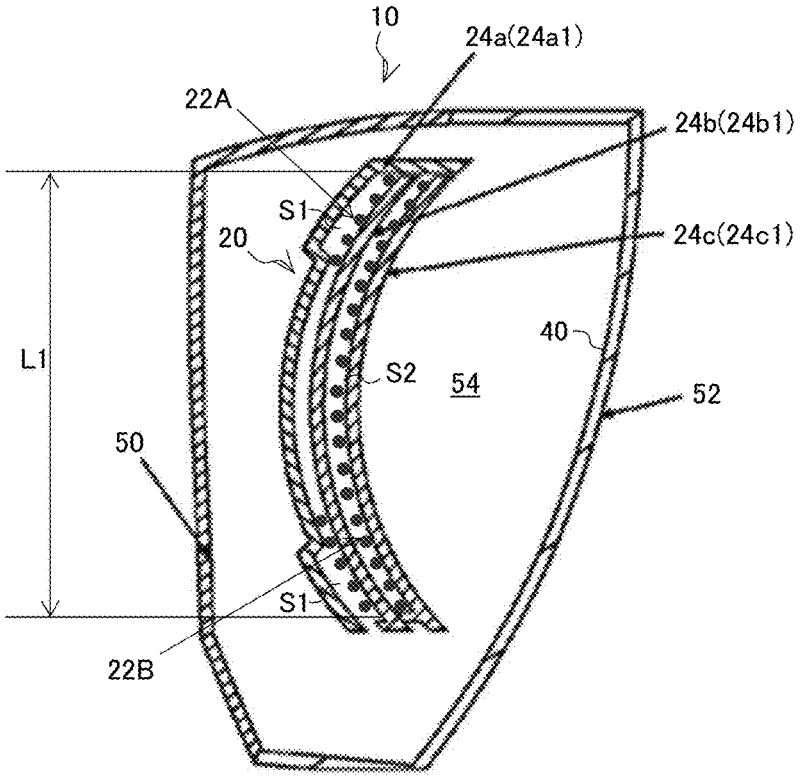
FIG. 2A is an A-A cross-sectional view of FIG. 1.
Figure 2B:
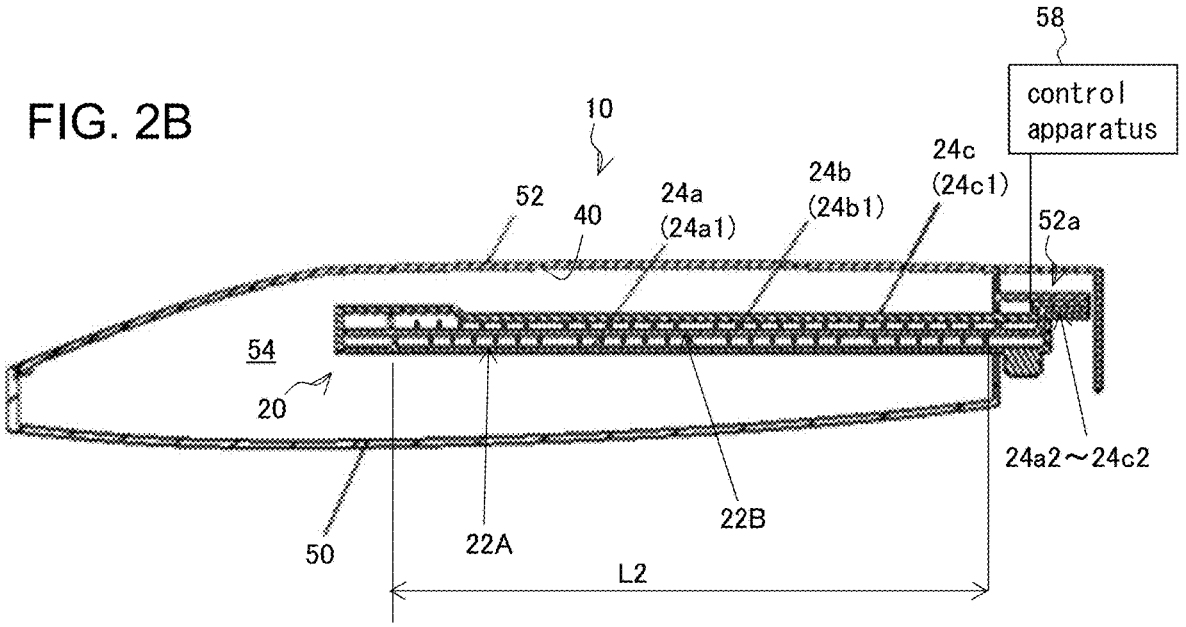
FIG. 2B is a B-B cross-sectional view of FIG. 1.

FIG. 2A is an A-A cross-sectional view of FIG. 1, and FIG. 2B is a B-B cross-sectional view of FIG. 1.

As illustrated in FIG. 2A and FIG. 2B, the vehicular lamp fitting 10 of Embodiment 1 includes a lamp fitting unit 20 and a reflection surface 40. The lamp fitting unit 20 is disposed in a lamp chamber 54 constituted of an outer lens 50 and a housing 52, and is installed in the housing 52.

Figure 3:
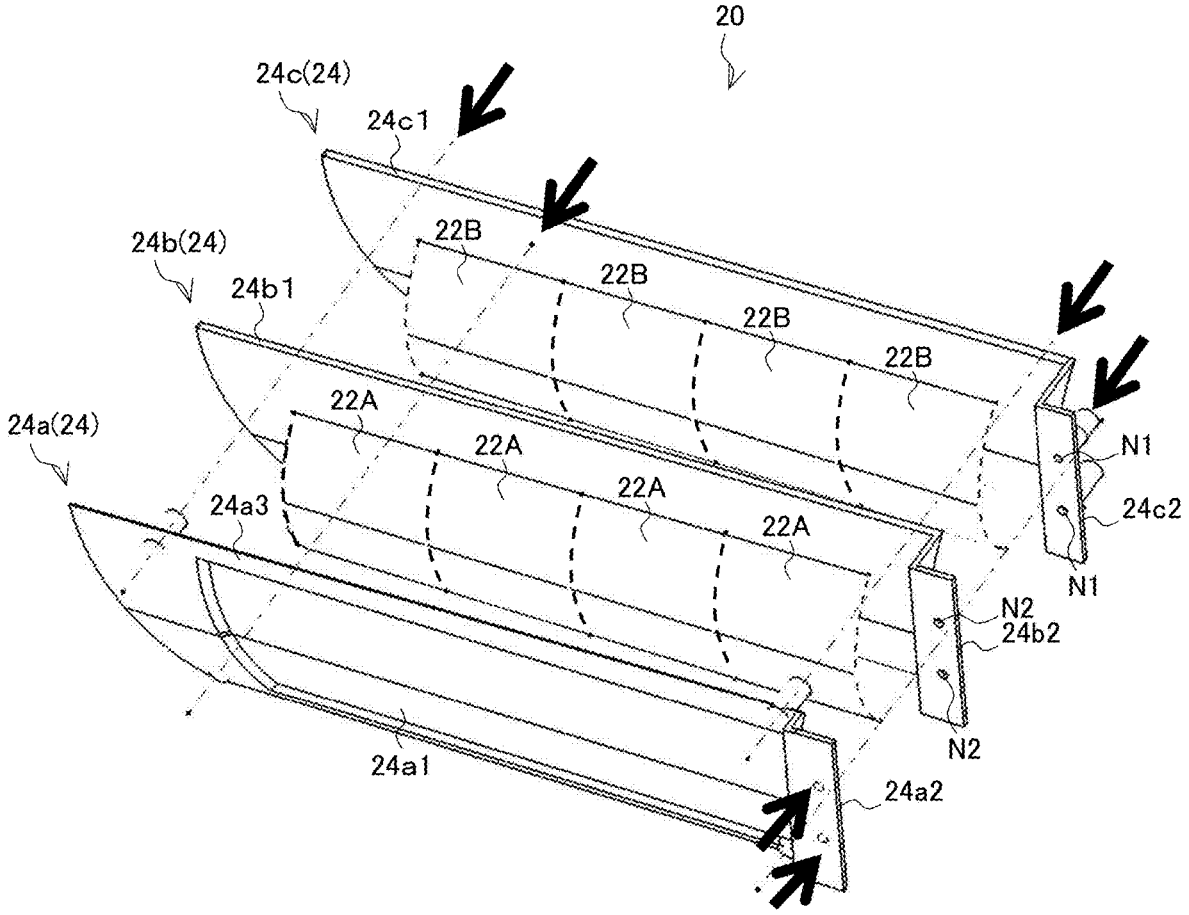
FIG. 3 is an exploded perspective view of the lamp fitting unit 20.

FIG. 3 is an exploded perspective view of the lamp fitting unit 20.

As illustrated in FIG. 3, the lamp fitting unit 20 includes: a tail lamp film light source 22A (four tail lamp film light sources are illustrated in FIG. 3 as an example, and are hereafter called the first film light source 22A); stop lamp film light source 22B (four stop lamp film light sources are illustrated in FIG. 3 as an example, and are hereafter called the second film light source 22B); and film light source support units 24 (24*a* to 24*c*). Hereafter the first film light source 22A and the second film light source 22B are called the film light sources 22 if no special distinction is required.

The film light source will be described first.

Figure 4A:
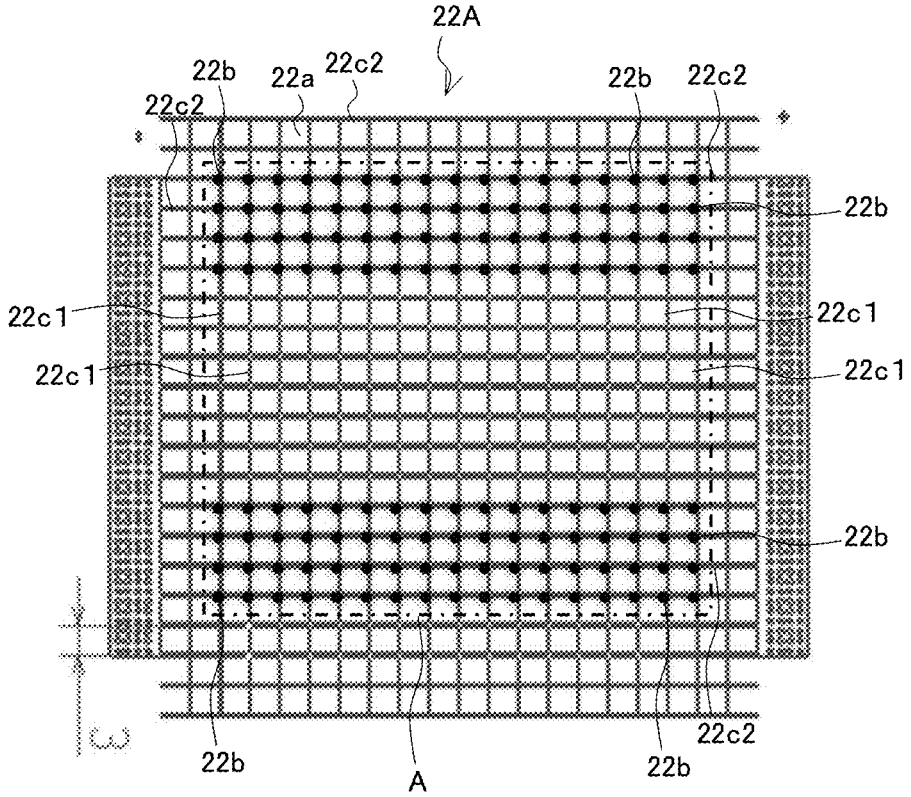
FIG. 4A is an example (front view) of the first film light source 22A.
Figure 4B:
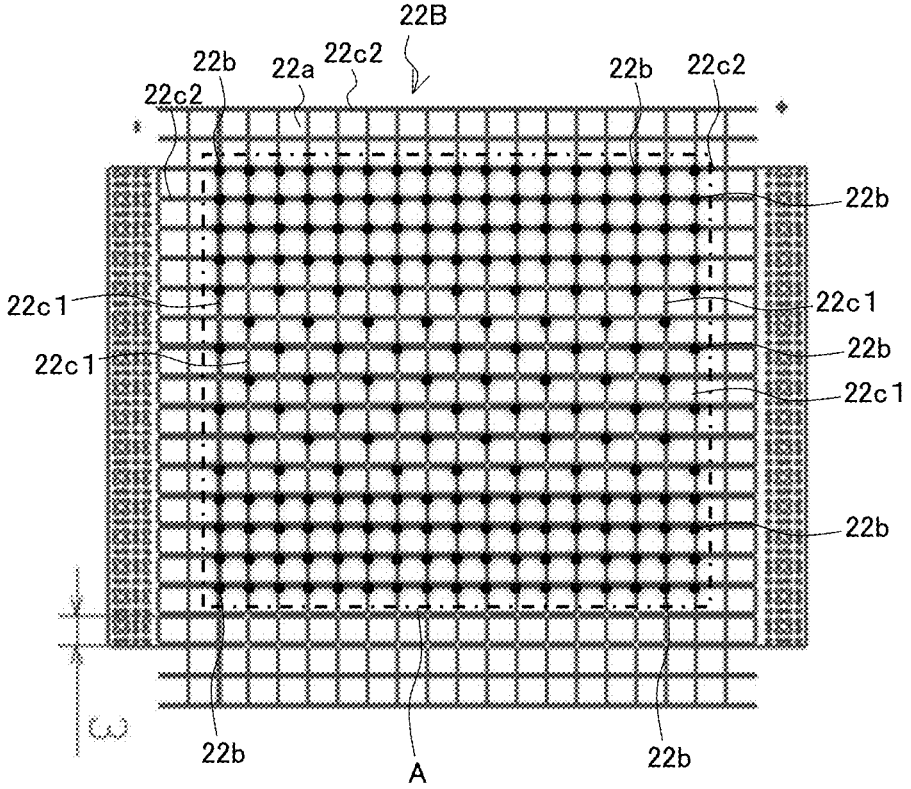
FIG. 4B is an example (front view) of the second film light source 22B.

FIG. 4A is an example (front view) of the first film light source 22A, and FIG. 4B is an example (front view) of the second film light source 22B.

As illustrated in FIG. 4A, the first film light source 22A includes a film 22*a* and a plurality of semiconductor light-emitting elements 22*b*. The second film light source 22B has a similar configuration as the first film light source 22A, except that a number of semiconductor light-emitting elements 22*b* is different, hence in the following, the first film light source 22A will be described representing these film light sources 22A and 22B. In both the first film light source 22A and the second film light source 22B, the density of the disposed semiconductor light-emitting elements 22*b* is changed on the film surface. The semiconductor light-emitting elements 22*b* are disposed so as to be dense near the upper and lower edges, and sparse near the center. A number of the semiconductor light-emitting elements 22*b* of the first film light source 22A and a number of the semiconductor light-emitting elements 22*b* of the second film light source 22B may be the same in some cases. Further, the arrangement of the semiconductor light-emitting elements 22*b* of the first film light source 22A and the arrangement of the semiconductor light-emitting elements 22*b* of the second film light source 22B may be different or may be the same depending on the case.

The plurality of semiconductor light-emitting elements 22*b* are fixed to (mounted on) the film 22*a* by performing bump connection between each electrode pad and a wiring pattern 22*c* formed on the film 22*a*, for example. This aspect will be described later.

The film 22*a* is a flexible transparent film having a front surface and a rear surface which is on the opposite side of the front surface. The film 22*a* may be colorless transparent, may be colored transparent, or in some cases may be opaque. In Embodiment 1, the first film light source 22A and the second film light source 22B are disposed in an overlapped state, hence in the first film light source 22A (front side), a transparent film is used for the film 22*a*, so that the light Ray 1 from the semiconductor light-emitting elements 22*b* of the second film light source 22B (rear side) transmitted through the film 22*b*. In the second film light source 22B as well, a transparent film 22*a* is used for the film 22*a*, so that the light Ray 2 from the semiconductor light-emitting elements 22*b* of the second film light source 22B transmitted through the film 22*a*, and is directed to a reflection surface 40 disposed on the rear side. The thickness of the film 22*a* is about 100 μm or less, for example. The outer shape of the film 22*a* is a rectangle, for example. The material of the film 22*a* is, for example, polyimide, polyethylene terephthalate (PET), polyethylene naphthalate (PEN), cellulose nano-fiber or polyamide imide.

A wiring pattern 22*c* (22*c*1, 22*c*2) is formed on the film 22*a*. The wiring pattern 22*c* is a wiring pattern made of such metal as silver, copper and gold. The wiring pattern 22*c* may be a transparent wiring pattern made of indium tin oxide (ITO) or the like.

The wiring pattern 22*c* includes a plurality of vertical wiring patterns 22*c*1 which are disposed in parallel in the vertical direction, and a plurality of horizontal wiring patterns 22*c*2 which are disposed in parallel in the horizontal direction. The vertical wiring patterns 22*c*1 and the horizontal wiring patterns 22*c*2 cross each other and constitutes a lattice pattern. Besides the lattice pattern, various design patterns (e.g. patterns including straight lines and curved lines) may be used for the wiring pattern 22*c*.

The vertical wiring pattern 22*c*1 is a wiring pattern to supply driving current to the semiconductor light-emitting elements 22*b*.

Figure 5:
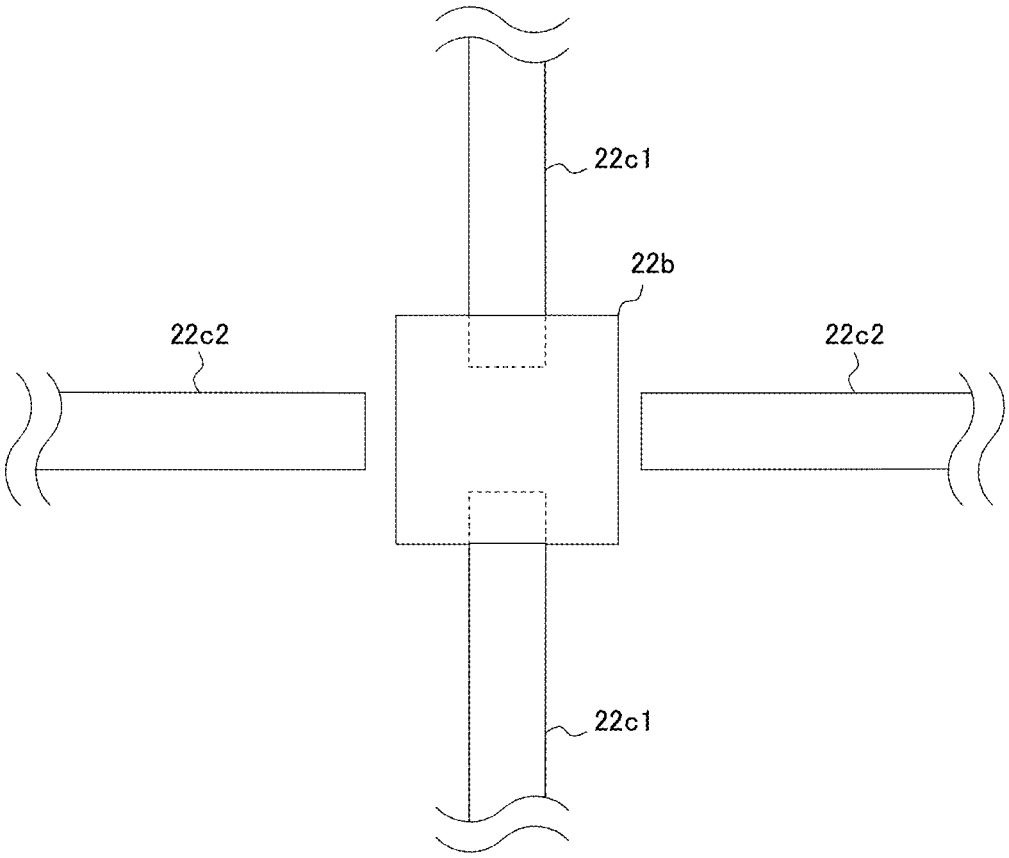
FIG. 5 is a partial enlarged view of the wiring pattern 22*c* around the semiconductor light-emitting element 22*b*.

FIG. 5 is a partial enlarged view of the wiring pattern 22*c* around the semiconductor light-emitting element 22*b*.

As illustrated in FIG. 5, the horizontal wiring pattern 22*c*2 is an intermittent wiring pattern, where the portion near the vertical wiring pattern 22*c*1 is disconnected. The horizontal wiring pattern 22*c*2 is a wiring pattern (dummy wiring pattern) to visually recognize the entire vertical wiring pattern 22*c*1 and the horizontal wiring pattern 22*c*2 as a lattice pattern, and is not a wiring pattern to supply the driving current to the semiconductor light-emitting element 22*b*. The vertical wiring pattern 22*c*1 and the horizontal wiring pattern 22*c*2 also play a role of radiating heat generated in the semiconductor light-emitting element 22*b* respectively.

The wiring pattern 22*c* can be formed as follows.

First on the front surface of the film 22*a*, a solution, in which conductive particles (e.g. conductive nano particles) and an insulation material are dispersed, or a solution, in which conductive particles coated by an insulation material layer are dispersed, is applied, so as to form a film of conductive particles coated by the insulation material.

Then the laser light is radiated to the formed film to sinter the film. If Ag is used, for example, as the conductive particles, a silver wiring pattern 22*c* can be formed here (e.g. see Japanese Patent Application Publication No. 2018-4995).

The wiring pattern 22*c* may also be formed by forming a metal film (e.g. copper) on one surface of the film 22*a*, and performing a known etching thereon.

The plurality of semiconductor light-emitting elements 22*b* are mounted on the film 22*a*. Further, in some cases, electronic components (e.g. resistors) other than the semiconductor light-emitting elements 22*b* may be mounted on the film 22*a*.

The semiconductor light-emitting element 22*b* is a semiconductor light-emitting element of which color of the emitted light is red (in the case of constructing a tail lamp or stop lamp). The color of the emitted light of the semiconductor light-emitting element 22*b* may be amber (in the case of constructing a turn signal light), or may be white (in the case of constructing a rear lamp).

The semiconductor light-emitting element 22*b* is constituted by an LED chip (LED element) alone. However the semiconductor light-emitting element 22*b* may be constituted by a combination of an LED chip and a wavelength conversion material, such as phosphor or quantum dots, or may be constituted by a combination of a plurality of LED chips.

The size of the semiconductor light-emitting element 22*b* is about 300 $\mu m^2$, for example. The outer shape of the semiconductor light-emitting element 22*b* is a square, for example. However in some cases the outer shape of the semiconductor light-emitting element 22*b* may be a rectangle, a triangle or the like.

The semiconductor light-emitting element 22*b* includes a substrate, an n-type semiconductor layer, a light-emitting layer, a p-type semiconductor layer, an n-side electrode pad, a p-side electrode pad and the like (not illustrated). The substrate may be transparent or opaque with respect to the light radiated from the light emitting layer, but the substrate of the semiconductor light-emitting element 22*b* that is flip-chip mounted is preferably transparent. The substrate of the semiconductor light-emitting element 22*b* that is face-up mounted is preferably opaque, but may be transparent. The n-type semiconductor layer, light-emitting layer and p-type semiconductor layer are layered on the substrate. The n-type electrode pad and the p-type electrode pad are hereafter called electrode pads 22*b*1.

The semiconductor light-emitting elements 22*b* are fixed to at least the front surface of the film 22*a* in a state of being disposed two-dimensionally (flip-chip mounting). For example, in FIG. 4A, each semiconductor light-emitting element 22*b* of the first film light source 22A is fixed to a black dot portion where the vertical wiring pattern 22*c*1 and the horizontal wiring pattern 22*c*2 cross. In FIG. 4B, on the other hand, each semiconductor light source 22*b* of the second film light source 22B is fixed to a black dot portion where the vertical wiring pattern 22*c*1 and the horizontal wiring pattern 22*c*2 cross.

The semiconductor light-emitting elements 22*b* are two-dimensionally disposed in a 50 $cm^2$ rectangular region A in the front view (see regions enclosed by dashed lines in FIG. 4A and FIG. 4B), for example, considering the surface area requirements specified for the stop lamp.

The disposition intervals of the semiconductor light-emitting elements 22*b* (that is, the intervals between the vertical wiring patterns 22*c*1 and the intervals between the horizontal wiring patterns 22*c*2) are 3 mm, for example. However, the positions where the semiconductor light-emitting elements 22*b* are disposed are not limited to the portions where the vertical wiring patterns 22*c*1 and the horizontal wiring patterns 22*c*2 cross, but may be various other positions considering the design of the vehicular lamp fitting.

Figure 6A:
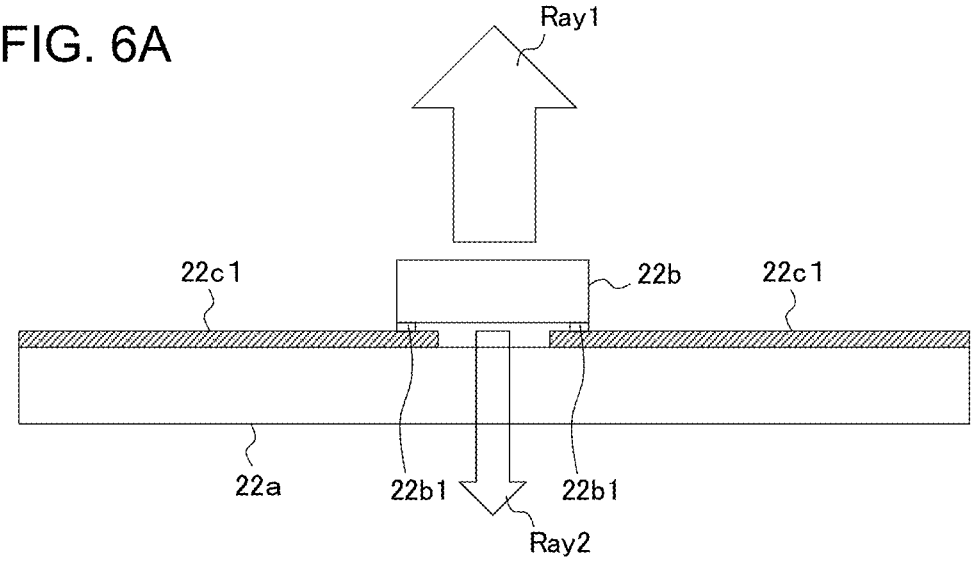
FIG. 6A is an example of flip-chip mounting.

FIG. 6A is an example of flip-chip mounting.

As illustrated in FIG. 6A, each semiconductor light-emitting element 22*b* is mounted on the film 22*a* in a state where the surface on the side of the electrode pad 22*b*1 being disposed (hereafter electrode surface) faces the front surface of the film 22*a* (flip-chip mounting). In concrete terms, the semiconductor light-emitting element 22*b* is fixed to the film 22*a* by bump connection between the electrode pad 22*b*1 and the wiring pattern 22*c* (vertical wiring pattern 22*c*1) formed on the film 22*a*. The semiconductor light-emitting elements 22*b* fixed to the film 22*a* may be sealed by resin or covered by a cover member (not illustrated).

Figure 6B:
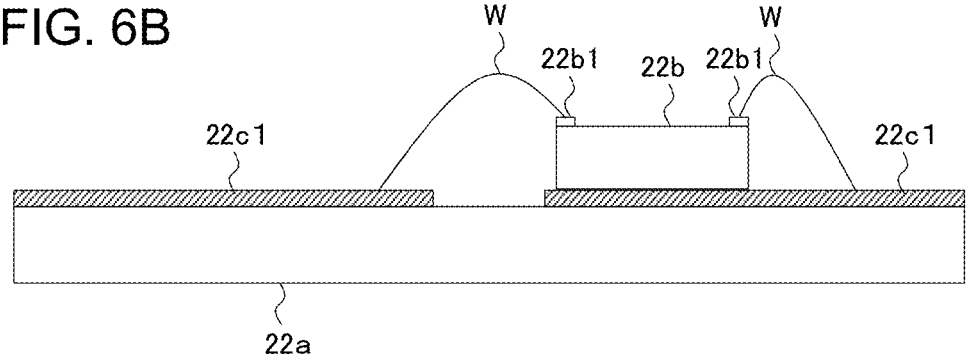
FIG. 6B is an example of face-up mounting.

FIG. 6B is an example of face-up mounting.

As illustrated in FIG. 6B, the semiconductor light-emitting element 22*b* may be mounted on the film 22*a* in a state where the surface on the opposite side of the electrode surface faces the front surface of the film 22*a* (face-up mounting). In this case, the semiconductor light-emitting element 22*b* is fixed to the film 22*a* (or the wiring pattern) by adhesive, such as silver paste and resin, for example. Then the electrode pad 22*b*1 and the wiring pattern 22*c* (vertical wiring pattern 22*c*1) are electrically connected by metal wire W (double wire).

Figure 6C:
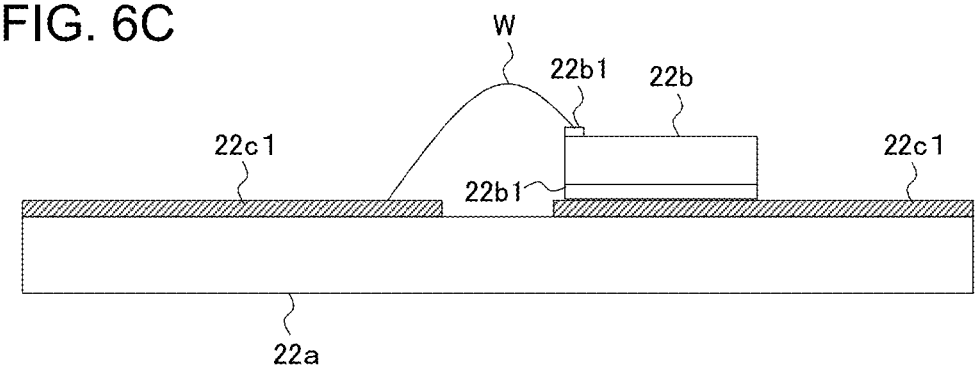
FIG. 6C is another example of face-up mounting.

FIG. 6C is another example of face-up mounting.

As illustrated in FIG. 6C, the semiconductor light-emitting element 22*b* is a semiconductor light-emitting element 22*b* on which electrode pads 22*b*1 are disposed, and is mounted on the film 22*a* in a state where a larger one of the electrode pads 22*b*1 facing each other faces the front surface of the film 22*a* (face-up mounting). In this case, the semiconductor light-emitting element 22*b* is fixed to the wiring pattern (vertical wiring pattern 22*c*1) by conductive adhesive such as silver paste, for example. Then the smaller one of the electrode pads 22*b*1 and the wiring pattern 22*c* (vertical wiring pattern 22*c*1) are electrically connected by a metal wire W (single wire).

The semiconductor light-emitting element 22*b* emits light by the driving current being supplied via the wiring pattern 22*c* (vertical wiring pattern 22*c*1). As illustrated in FIG. 6A, the light emitted from the semiconductor light-emitting element 22*b* includes the light Ray 1 which is emitted from the surface on the opposite side of the electrode surface, and the light Ray 2 which is emitted from the electrode surface.

The ratio of the Ray 1, which is emitted from the surface on the opposite side of the electrode surface, and the Ray 2, which is emitted from the electrode surface, differs depending on the structure of the semiconductor light-emitting element 22*b* and other factors, but is 7:3, for example. The thickness of each arrow in FIG. 6A indicates this ratio.

As illustrated in FIG. 6B and FIG. 6C, in the case of mounting the semiconductor light-emitting element 22*b* face-up, a film light source, which emits light only from one surface, is formed. In this case, silver is used for the vertical wiring pattern 22*c*1, or reflective silver paste is used as the adhesive, then light that is directed from the semiconductor light-emitting element 22*b* toward the film 22*a* is reflected, and is emitted from the surface on the opposite side of the film 22*a*.

Further, as illustrated in FIG. 6B, even in the case of mounting the semiconductor light-emitting element 22*b* face-up, a transparent substrate is used as the substrate of the semiconductor light-emitting element 22*b*, and a transparent adhesive is used as the adhesive which adheres the semiconductor light-emitting element 22*b* and the film 22*a* (or with the vertical wiring pattern 22*c*1 if the vertical wiring pattern 22*c*1 is a transparent electrode), for example, then similarly to FIG. 6A, a film light source which emits light on both one side and the opposite side thereof is formed.

The film light source support unit 24 will be described next.

The film light source support unit 24 supports the first and second film light sources 22A and 22B in a state where the film 22*a* is maintaining a predetermined shape (e.g. flat shape or curved shape). As illustrated in FIG. 3, the film light source support unit 24 includes a front lens 24*a*, an intermediate lens 24*b*, a rear lens 24*c* and a lens fixing unit 24*d* (e.g. screws). In FIG. 3, the lens fixing unit 24*d* is omitted. The material of each lens 24*a* to 24*c* is a transparent resin, such as acrylic or polycarbonate.

As illustrated in FIG. 3, the intermediate lens 24*b* includes a lens main body 24*b*1 and a flange unit 24*b*2. The lens main body 24*b*1 is a lens that is a transparent plate having a vertical cross-section which is convexly curved forward (see FIG. 2A), and having a horizontal cross-section which is a straight line (see FIG. 2B). The first film light source 22A is positioned with respect to the intermediate lens 24*b*, and is fixed to the intermediate lens 24*b* in a state where the rear face of the first film light source 22A faces the front surface of the intermediate lens 24*b*, as illustrated in FIG. 3 (e.g. adhered or roughly adhered by double-sided tape). Thereby the film light source 22A is supported in a state of being curved along the intermediate lens 24*b*. The first film light source 22A may be sandwiched between the front lens 24*a* and the intermediate lens 24*b*.

Similarly to the intermediate lens 24*b*, the rear lens 24*c* includes a lens main body 24*c*1 and a flange unit 24*c*2. The lens main body 24*c*1 is a lens that is a transparent plate having a vertical cross-section which is convexly curved forward (see FIG. 2A), and having a horizontal cross-section which is a straight line (see FIG. 2B). The second film light source 22B is positioned with respect to the rear lens 24*c*, and is fixed to the rear lens 24*c* in a state where the rear face of the second film light source 22B faces the front surface of the rear lens 24*c*, as illustrated in FIG. 3 (e.g. adhered or roughly adhered by double-sided tape). Thereby the second film light source 22B is supported in a state of being curved along the rear lens 24*c*. The second film light source 22B may be sandwiched between the intermediate lens 24*b* and the rear lens 24*c*.

The front lens 24*a* includes a lens main body 24*a*1, a flange unit 24*a*2 and a frame unit 24*a*3 which encloses the lens main body 24*a*1. The lens main body 24*a*1 is a lens that is a transparent plate having a vertical cross-section which is convexly curved forward (see FIG. 2A), and having a horizontal cross-section which is a straight line (see FIG. 2B). The frame unit 24*a*3 may be decorated by aluminum deposition or the like, or may be a plain transparent plate. By making the lenses 24*a*, 24*b*, 24*c* and the films 22*a* of the first and second film light sources 22A and 22B transparent, the presence of the light sources does not stand out when the light sources (e.g. semiconductor light-emitting elements 22*b*) are not emitting light.

The lens fixing unit 24*d* is a unit that fixes the front lens 24*a*, the intermediate lens 24*b* and the rear lens 24*c* in a mutually positioned state, and is screws, for example.

Figure 7:
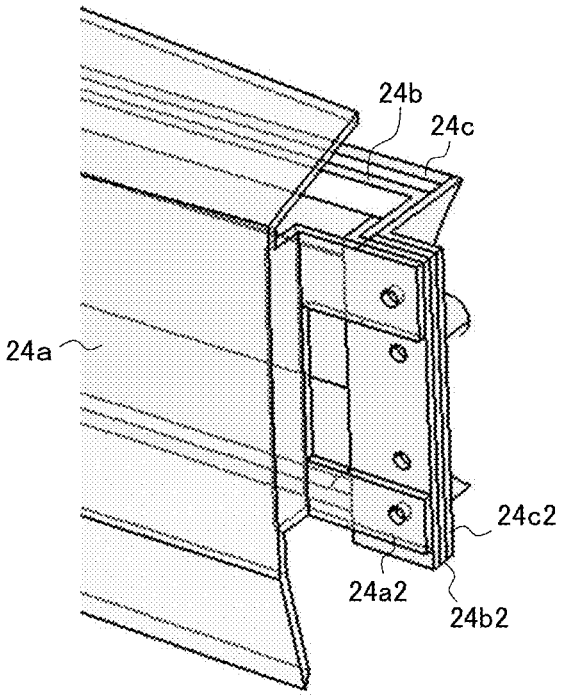
FIG. 7 is a perspective view of each flange unit 24*a*2 to 24*c*2 in the overlapped state.

The front lens 24*a*, the intermediate lens 24*b* and the rear lens 24*c* are set in a state where the front surface of the first film light source 22A (semiconductor light-emitting elements 22*b*) and the rear surface of the front lens 24*a* face each other via a space S1 (see FIG. 2A); the front surface of the second film light source 22B (semiconductor light-emitting elements 22*b*) and the rear surface of the intermediate lens 24*b* face each other via a space S2 (see FIG. 2A); and flange units 24*a*2 to 24*c*2 of respective lenses 24*a* to 24*c* overlap each other, as illustrated in FIG. 7, and the front lens 24*a*, the intermediate lens 24*b* and the rear lens 24*c* are fixed in this state. Here the screws (not illustrated) of the lens fixing unit 24*d* are inserted in the screw hole N1 formed in the rear lens 24*c* (flange unit 24*c*2), and the screw hole N2 formed in the intermediate lens 24*b* (flange unit 24*b*2), and these screws are screwed into the front lens 24*a* (flange unit 24*a*2). FIG. 7 is a perspective view of each flange unit 24*a*2 to 24*c*2 in the overlapped state. A number of screwing locations in each lens 24*a* to 24*c* is not limited to two. For example, the number may be six, as indicated by the six arrow marks in FIG. 3.

Figure 8:
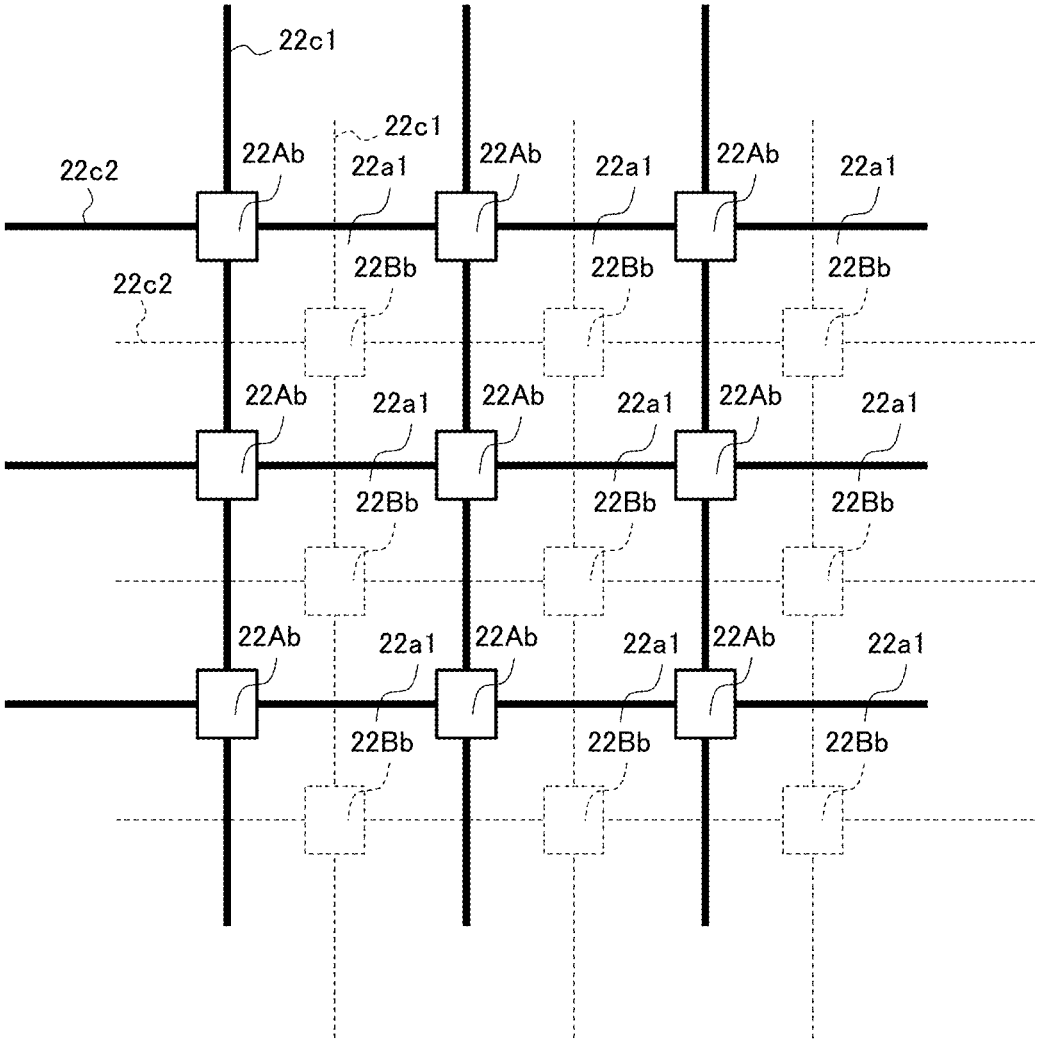
FIG. 8 is a front view displaying through the first film light source 22A and the second film light source 22B disposed behind the first film light source 22A.

FIG. 8 is a front view displaying through the first film light source 22A and the second film light source 22B disposed behind the first film light source 22A. In FIG. 8, the reference sign 22Ab indicates the semiconductor light-emitting element 22*b* of the first film light source 22A, and the reference sign 22Bb indicates the semiconductor light-emitting element 22*b* of the second film light source 22B.

In the state where each lens 24*a* to 24*c* is fixed by the screws as mentioned above, the first and second film light sources 22A and 22B are disposed in the same range (see the ranges indicated by L1 and L2 in FIG. 2A and FIG. 2B) in the front view, so as to be overlapped in the longitudinal direction of the vehicle (in tandem in the longitudinal direction of vehicle), as illustrated in FIG. 2A and FIG. 2B. "The same range" refers to the range that satisfies the area requirements specified by the laws and regulations, and is 50 $cm^2$, for example, in the case of the stop lamp.

The advantages of disposing the first and second film light sources 22A and 22B in the same range in the front view like this, so as to be overlapped in the longitudinal direction of the vehicle, are as follows.

In the above mentioned prior art (see Japanese Patent Application Publication No. 2016-58136), for example, the organic EL panel which functions as the tail lamp and the organic EL panel which functions as the stop lamp are disposed in parallel (side by side) in the front view, which means that the size of the vehicle lamp fitting in the front view is large.

In Embodiment 1, on the other hand, the first and second film light sources 22A and 22B are disposed in the same range in the front view, so as to be overlapped in the longitudinal direction of the vehicle (in tandem in the longitudinal direction of the vehicle), hence compared with the above mentioned prior art, the size of the vehicle lamp fitting in the front view can be smaller.

Further, as illustrated in FIG. 8, in the state where each lens 24*a* to 24*c* is fixed by the screws as mentioned above, the semiconductor light-emitting elements 22*b* (e.g. 22Bb) of one of the first and second film light sources 22A and 22B are disposed so as to not be overlapped with the semiconductor light-emitting elements 22*b* (e.g. 22Ab) of the other film light source of the first and second film light sources 22A and 22B and the wiring pattern 22*c*, but to be overlapped with the film portion 22*a*1 of the other film light source in the front view. Each of the semiconductor light-emitting elements 22*b* of one of the film light sources is disposed in a position surrounded by the semiconductor light-emitting elements 22*b* of the other film light sources in the front view. In other words, each of the semiconductor light-emitting elements 22Ab (22Bb) is disposed in a position surrounded by the semiconductor light-emitting elements 22Bb (22Ab) in the front view.

Thereby the light Ray 1 that is emitted forward from each semiconductor light-emitting element 22*b* (22Bb) of the second film light source 22B which is disposed in the rear transmitted through the film portion 22*a*1 among the semiconductor light-emitting elements 22*b* (22Ab) of the first film light source 22A disposed in the front and emitted forward, without being interrupted (or hardly being interrupted) by the semiconductor light-emitting elements 22*b* (22Ab) of the first film light source 22A disposed in the front and the wiring pattern 22*c*. This improves the light utilization efficiency of the light Ray 1, which is emitted forward from each semiconductor light-emitting element 22*b* (22Bb) of the second film light source 22B disposed in the rear.

On the other hand, the light Ray 2 that is emitted backward from each semiconductor light-emitting element 22*b* (22Ab) of the first film light source 22A which is disposed in the front transmits backward through the film portion among the semiconductor light-emitting elements 22*b* (22Bb) of the second film light source 22B disposed in the rear without being interrupted (or hardly being interrupted) by the semiconductor light-emitting elements 22*b* (22Bb) of the second film light source 22B disposed in the rear and the wiring pattern 22*c*. This improves the light utilization efficiency of the light Ray 2, which is emitted backward from each semiconductor light-emitting element 22*b* (22Ab) of the first film light source 22A disposed in the front.

Figure 9:
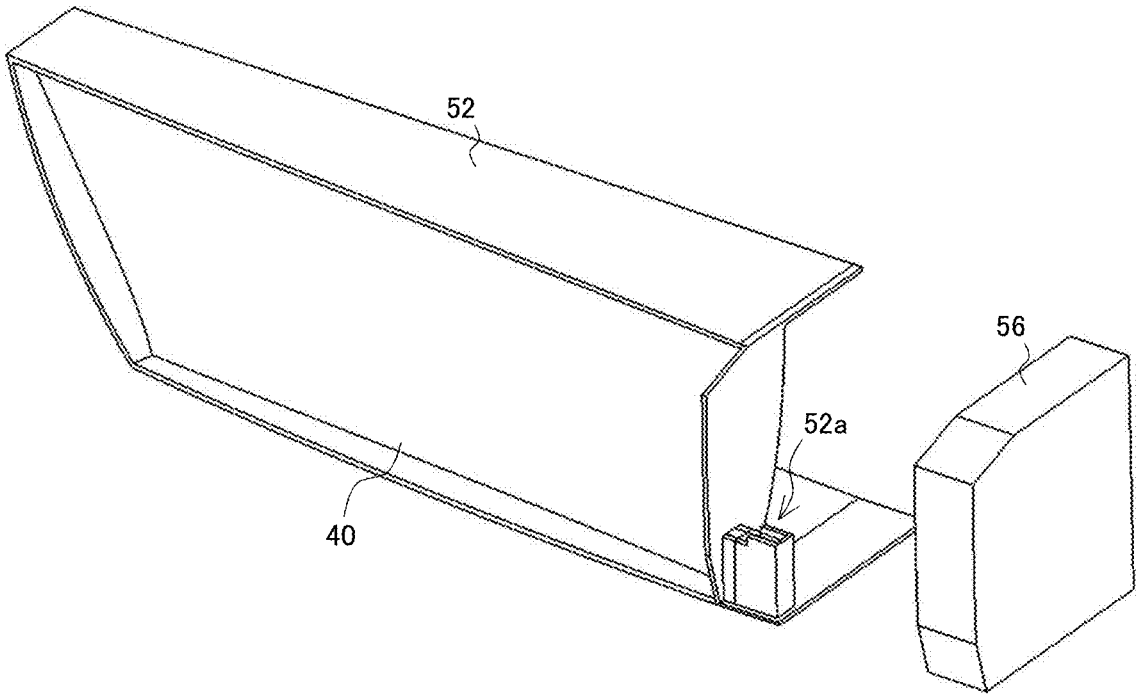
FIG. 9 is a perspective view of the housing 52.

FIG. 9 is a perspective view of the housing 52.

The lamp fitting unit 20 configured as described above is fixed in a state of being positioned in the housing 52. In concrete terms, the lamp fitting unit 20 is fixed in a state of being positioned in the housing 52 by fitting each flange unit 24*a*2 to 24*c*2 (see FIG. 7), which are overlapped as above, into groove portions 52*a* (see FIG. 9), which are formed in the housing 52. Each flange portion 24*a*2 to 24*c*2 corresponds to the lamp fitting unit support unit.

Thereby the lamp fitting unit 20 is disposed in the lamp chamber 54 in a state of maintaining a space between the lamp fitting unit and the housing 52 (see FIG. 2A and FIG. 2B). The groove portion 52*a*, where each flange portion 24*a*2 to 24*c*2 is fitted in, is covered by an extension 56 (see FIG. 9).

As illustrated in FIG. 2A and FIG. 2B, a reflection surface 40 is disposed in the back of the lamp fitting unit 20. The reflection surface 40 is formed by performing embossing processing on the front surface of the housing 52, and depositing aluminum on the embossed front surface (embossed surface) of the housing 52.

The reflection surface 40 is disposed in a state of facing the rear surface of the film 22*a* of the second film light source 22B, and reflects the light Ray 2 which is emitted from a part or all of the plurality of semiconductor light-emitting elements 22*b* and transmitted through the film 22*a*. In concrete terms, the reflection surface 40 reflects the light Ray 2 which is emitted from the electrode surface of the semiconductor light-emitting element 22*b* (22Ba) of the first film light source 22A, transmitted through the film portion of the second film light source 22B, and emitted backward, and the light Ray 2 which is emitted from the electrode surface or the semiconductor light-emitting element 22*b* (22Bb) of the second film light source 22B, and emitted backward. The reflection surface 40 may be omitted.

The light-emitting patterns of the first and second film light sources 22A and 22B (semiconductor light-emitting elements 22*b*) will be described next. The first and second film light sources 22A and 22B are connected to a control apparatus 58 (see FIG. 2B), to control the light-emitting state (lighting state) of each semiconductor light-emitting element 22*b*.

An example of the light-emitting pattern when the vehicular lamp fitting 10 functions as a tail lamp will be described first.

When the vehicular lamp fitting 10 functions as the tail lamp, a part or all of the respective semiconductor light-emitting elements 22*b* of the first film light source 22A and the second film light source 22B are emitted according to a first light-emitting pattern.

The first light-emitting pattern is a pattern in which all the semiconductor light-emitting elements 22*b* of the first film light source 22A (see the portions indicated by the black dots in FIG. 4A) and all the semiconductor light-emitting elements 22*b* of the second film light source 22B (see the portions indicated by the black dots in FIG. 4B) emit light at a first brightness, for example. The first light-emitting pattern is not limited to this. For example, for the first light-emitting pattern, a light-emitting pattern, in which a part of the semiconductor light-emitting elements 22*b* are turned OFF or dimmed, may be used. Further, for the first light-emitting pattern, a light-emitting pattern, in which brightness gradually changes, may be used. Furthermore, for the first light-emitting pattern, a light-emitting pattern, in which the brightness of each semiconductor light-emitting element 22*b* is changed, may be used. Thereby a perspective (perception of depth) can be expressed.

The first light-emitting pattern is not limited to a static light-emitting pattern, but may be a dynamic light-emitting pattern of which brightness, light-emitting shapes, light-emitting position and so forth change over time.

In the case where the respective semiconductor light-emitting elements 22*b* of the first film light source 22A and the second film light source 22B emit light according to the first light-emitting pattern, as described above, a tail lamp light distribution pattern is formed by the light Ray 1, which is emitted forward from the semiconductor light-emitting elements 22*b* (22Ab) of the first film light source 22A disposed in the front, and the light Ray 1, which is emitted forward from the semiconductor light-emitting elements 22*b* (22Bb) of the second film light source 22B disposed in the rear, transmitted through the film portion 22*a*1 of the first film light source 22A disposed in the front, and emitted forward.

Further, the reflection surface 40 emits light by reflecting the light Ray 2, which is emitted backward from the semiconductor light-emitting elements 22*b* (22Bb) of the second film light source 22B disposed in the rear, and the light Ray 2, which is emitted backward from the semiconductor light-emitting elements 22*b* (22Ab) of the first film light source 22A disposed in the front via the film 22*a*, transmitted through the film portion of the second film light source 22B disposed in the rear, and emitted backward.

As described above, when the vehicular lamp fitting 10 functions as the tail lamp, the first film light source 22A, the second film light source 22B and the reflection surface 40 emit light respectively, and the second film light source 22B and the reflection surface 40, which emit light behind the first film light source 22A, are visually recognized through the first film light source 22A. Thereby a three-dimensional light emitting appearance, have a perception of depth, is implemented.

Also as described above, the film light source support units 24 (24*a* to 24*c*) support the first and second film light sources 22A and 22B in the state of maintaining a predetermined shape (e.g. curved shape). Thereby the respective semiconductor light-emitting elements 22*b* of the first and second film light sources 22A and 22B are three-dimensionally disposed. This also implements three-dimensional light-emitting appearances with a perception of depth.

The lamp fitting unit 20 is disposed in the lamp chamber 54 in the state of maintaining a space between the lamp fitting unit and the housing 52, therefore a light-emitting appearance, that is visually recognized as if the lamp fitting unit 20 were floating in the lamp chamber 54, is implemented.

An example of the light-emitting pattern when the vehicular lamp fitting 10 functions as a stop lamp will be described next.

When the vehicular lamp fitting 10 functions as the stop lamp, a part or all of the respective semiconductor light-emitting elements 22*b* of the first film light source 22A and the second film light source 22B are emitted according to a second light-emitting pattern, which is different from the first light-emitting pattern.

The second light-emitting pattern is a pattern in which all the semiconductor light-emitting elements 22*b* of the first film light source 22A (see the portions indicated by the black dots in FIG. 4A) and all the semiconductor light-emitting elements 22*b* of the second film light source 22B (see the portions indicated by the black dots in FIG. 4B) emit light at a second brightness (second brightness>first brightness), for example. The second light-emitting pattern is not limited to this. For example, for the second light-emitting pattern, a light-emitting pattern, in which a part of the semiconductor light-emitting elements 22*b* are turned OFF or dimmed, may be used. Further, for the second light-emitting pattern, a light-emitting pattern, in which brightness gradually changes may be used. Furthermore, for the second light-emitting pattern, a light-emitting pattern, in which the brightness of each semiconductor light-emitting element 22*b* is changed, may be used. Thereby a perspective (perception of depth) can be expressed.

The second light-emitting pattern is not limited to a static light-emitting pattern, but may be a dynamic light-emitting pattern in which brightness, light-emitting shape, light-emitting position and so forth change over time.

In the case where the respective semiconductor light-emitting elements 22*b* of the first film light source 22A and the second film light source 22B emit light according to the second light-emitting pattern, as described above, the stop lamp light distribution pattern is formed by the light Ray 1 which is emitted forward from the semiconductor light-emitting elements 22*b* (22Ab) of the first film light source 22A disposed in the front, and the light Ray 1 which is emitted forward from the semiconductor light-emitting elements 22*b* (22Bb) of the second film light source 22B disposed in the back, transmitted through the film portion 22*a*1 of the first film light source 22A disposed in the front, and emitted forward.

Further, the reflection surface 40 emits light by reflecting the light Ray 2 which is emitted backward from the semiconductor light-emitting elements 22*b* (22Bb) of the second film light source 22B disposed in the back, and the light Ray 2 which is emitted backward from the semiconductor light-emitting elements 22*b* (22Ab) of the first film light source 22A disposed in the front via the film 22*a*, transmitted through the film portion of the second film light source 22B disposed in the rear, and emitted backward.

As described above, when the vehicular lamp fitting 10 functions as the stop lamp, the first film light source 22A, the second film light source 22B and the reflection surface 40 emit light respectively, and the second film light source 22B and the reflection surface 40, which emit light behind the first film light source 22A, are visually recognized through the first film light source 22A. Thereby a three-dimensional light-emitting appearance, having a perspective of depth, is implemented.

Also as described above, the film light source support units 24 (24*a* to 24*c*) support the first and second film light sources 22A and 22B in the state of maintaining a predetermined shape (e.g. curved shape). Thereby the respective semiconductor light-emitting elements 22*b* of the first and second film light sources 22A and 22B are three-dimensionally disposed. This also implements a three-dimensional light-emitting appearance having a perspective of depth.

The lamp fitting unit 20 is disposed in the lamp chamber 54 in the state of maintaining a space between the lamp fitting unit and the housing 52, therefore a light-emitting appearance, that is visually recognized as if the lamp fitting unit 20 were floating in the lamp chamber 54, is implemented.

As described above, according to the vehicular lamp fitting 10 of Embodiment 1, a vehicular lamp fitting having a new light-emitting appearance, which satisfies light distribution standards specified by laws and regulations, and is capable of implementing various levels of brightness and light-emitting patterns having different light-emitting shapes (various light-emitting graphics) can be provided.

This is because the vehicular lamp fitting 10 has the first and second film light sources 22A and 22B, that include a plurality of semiconductor light-emitting elements 22*b* which are fixed at least to the front surface of the film 22*a* in a state of being disposed two-dimensionally (display-like), and as a result this configuration allows to implement various levels of brightness and light-emitting patterns having different light-emitting shapes (various light-emitting graphics) by independently turning the plurality of semiconductor light-emitting elements 22*b* ON or OFF.

According to Embodiment 1, the light utilization efficiency of the light Ray 2, which is emitted backward from the semiconductor light-emitting elements 22*b* of the first and second film light sources 22A and 22B, improves. In other words, the reflection surface 40 can emit light by the light Ray 2, which is emitted backward from the semiconductor light-emitting elements 22*b* of the first and second film light sources 22A and 22B. Thereby the light emitted from the reflection surface 40 is visually recognized via the first and second film light sources 22A and 22B (film 22*a*), and three-dimensional light-emitting appearances having a perception of depth can be implemented.

The light distribution standards specified by laws and regulations can be satisfied (particularly in the case of a stop lamp and a turn signal lamp for which high brightness is demanded), because the semiconductor light-emitting elements 22*b* of which brightness is higher than an organic EL are used.

According to Embodiment 1, a vehicular lamp fitting having high product value, of which light-emitting appearances (light-emitting pattern) is completely different from a case of being used as a tail lamp and a case of being used as a stop lamp, can be provided.

This is because the first film light source 22A and the second film light source 22B are disposed in the same range in the front view, so as to be overlapped in the longitudinal direction of the vehicle.

Further, according to Embodiment 1, the first and second film light sources 22A and 22B having flexibility, on which the plurality of semiconductor light-emitting elements 22*b* are fixed in the state of being two-dimensionally disposed, are used. Therefore compared with a case of disposing each of the plurality of semiconductor light-emitting elements 22*b* independently at a predetermined position in a predetermined attitude, the plurality of semiconductor light-emitting elements 22*b* can be two-dimensionally or three-dimensionally disposed at predetermined positions in a predetermined attitude at the same time, merely by supporting the first and second film light sources 22A and 22B in the state of the film 22*a* maintaining a predetermined shape (e.g. curved shape) by the film light source support units 24 (24*a* to 24*c*).

According to Embodiment 1, the rear surface of the first film light source 22A and the front surface of the intermediate lens 24*b* are surface-contacted, and the rear surface of the second film light source 22B and the front surface of the rear lens 24*c* are surface-contacted, therefore the shapes of the first film light source 22A and the second film light source 22B (film) can be maintained in predetermined shapes (e.g. curved shapes).

In the above mentioned prior art (see Japanese Patent Application Publication No. 2016-58136), the organic EL panel, which functions as the tail lamp, and the organic EL panel which functions as the stop lamp, are disposed in parallel (side by side) in the front view, which means that the size of the vehicular lamp fitting in the front view is large.

In Embodiment 1, on the other hand, the first and second film light sources 22A and 22B are disposed in the same range in the front view, so as to be overlapped in the longitudinal direction of the vehicle (in tandem in the longitudinal direction of the vehicle), hence compared with the above mentioned prior art, the size of the vehicular lamp fitting 10 in the front view can be smaller.

According to Embodiment 1, a slim and light lamp fitting can be configured, where the front lens 24*a*, the intermediate lens 24*b* and the rear lens 24*c* are fixed in a state where the first and second film light sources 22A and 22B are disposed between the front lens 24*a* and the intermediate lens 24*b*, and between the intermediate lens 24*b* and the rear lens 24*c* respectively.

According to Embodiment 1, the rear surface of the first film light source 22A and the front surface of the intermediate lens 24*b* are surface-contacted, and the rear surface of the second film light source 22B and the front surface of the rear lens 24*c* are surface-contacted, therefore the shapes of the first film light source 22A and the second film light source 22B (film) can be maintained in predetermined shapes (e.g. curved shapes).

According to Embodiment 1, the front surface of the first film light source 22A faces the rear surface of the front lens 24*a* via a space S1, and the front surface of the second film light source 22B faces the rear surface of the intermediate lens 24*b* via a space S2, hence damage to the front surface of the first film light source 22A and the front surface of the second film light source 22B (a plurality of semiconductor light-emitting elements 22*b* mounted on the front surfaces), caused by contacting the rear surface of the front lens 24*a* and the rear surface of the intermediate lens 24*b*, can be prevented.

According to Embodiment 1, the emitted color of the semiconductor light-emitting elements 22*b* of the first film light source 22A and the emitted color of the semiconductor light-emitting elements 22*b* of the second film light source 22B are the same, therefore one lamp fitting unit 20 can implement multi-functions using a same color, such as a tail lamp (red) and a stop lamp (red).

According to Embodiment 1, the first light distribution pattern (e.g. tail lamp light distribution pattern) can be formed by causing a part or all of the plurality of semiconductor light-emitting elements 22*b* of the first film light source 22A and the second film light source 22B to emit light according to the first light emission pattern. Further, the second light distribution pattern (e.g. stop lamp light distribution pattern) can be formed by causing a part or all of the plurality of semiconductor light-emitting elements 22*b* to emit light according to the second light emission pattern.

According to Embodiment 1, the films 22*a* of the first and second film light sources 22A and 22B are transparent films, hence the light, which the semiconductor light-emitting elements 22*b* of the first and second film light sources 22A and 22B emit backward, transmits through the films 22*a*. Thereby the light utilization efficiency of the light emitted backward from the semiconductor light-emitting elements 22*b* of the first and second film light sources 22A and 22B improves.

According to Embodiment 1, the first and second film light sources 22A and 22B having flexibility, on which the semiconductor light-emitting elements 22*b* having brightness higher than an organic EL are fixed in the state of being two-dimensionally disposed, are used, hence the vehicular lamp fitting 10 that is slim and flexible, and has a sufficient quantity of light to form the stop lamp light distribution, the turn signal lamp light distribution and the like, can be provided.

Modifications will be described next.

In Embodiment 1, an example of applying the vehicular lamp fitting of the present invention to a vehicular signal lamp fitting, such as a tail lamp, a stop lamp and a turn signal lamp, was described, but the present invention is not limited to this. For example, the vehicular lamp fitting of the present invention may be applied to a DRL lamp, the interior illumination of the vehicle (e.g. indicator) an alarm lamp, and general lighting.

In Embodiment 1, an example when the light emission color of the semiconductor light-emitting elements 22*b* of the first film light source 22A, and the light emission color of the semiconductor light-emitting elements 22*b* of the second film light source 22B are the same, was described, but the present invention is not limited to this. For example, the light emission color of the semiconductor light-emitting elements 22*b* of the first film light source 22A and the light emission color of the semiconductor light-emitting elements 22*b* of the second film light source 22B may be different from each other.

For example, the light emission color of the semiconductor light-emitting elements 22*b* of the first film light source 22A may be red, and the light emission color of the semiconductor light-emitting elements 22*b* of the second film light source 22B may be amber.

Then one lamp fitting unit 20 can implement a multi-function vehicular lamp fitting having different colors, such as a tail lamp (red) and a turn signal lamp (amber).

An opaque film may be used for the film 22*a* of the film light source.

In Embodiment 1, an example when the lamp fitting unit 20 is configured using the two film light sources 22 (e.g. first and second film light sources 22A and 22B) which are overlapped in the longitudinal direction of the vehicle, was described, but the present invention is not limited to this.

For example, the lamp fitting unit 20 may be configured using film light sources which are not overlapped in the longitudinal direction of the vehicle.

Further, the lamp fitting unit 20 may be configured using three or more film light sources which are overlapped in the longitudinal direction of the vehicle.

Figure 10:
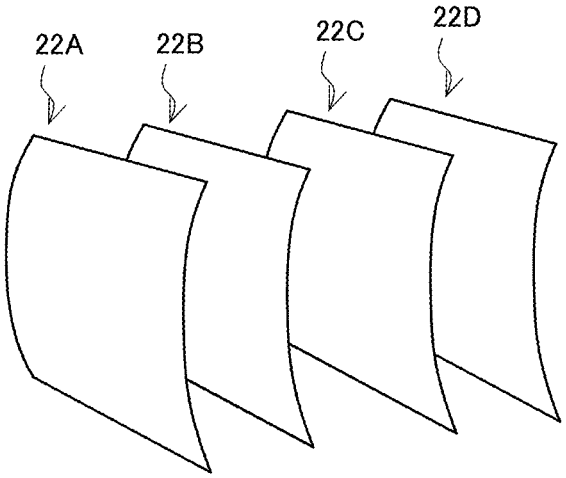
FIG. 10 is an example when the lamp fitting unit 20 is configured using four film light sources which are overlapped in the longitudinal direction of the vehicle.

FIG. 10 is an example when the lamp fitting unit 20 is configured using four film light sources which are overlapped in the longitudinal direction of the vehicle. In FIG. 10, the reference sign 22C indicates a film light source for a turn signal lamp (light emission color of the semiconductor light-emitting elements is amber), and the reference sign 22D indicates the film light source for a rear lamp (light emission color of the semiconductor light-emitting elements is white).

Figure 11A:
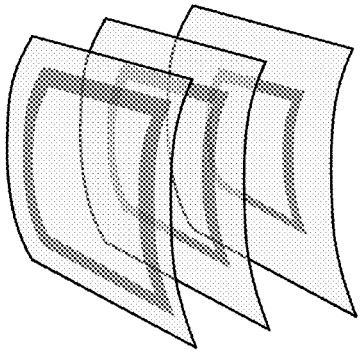
FIG. 11A and FIG. 11B are examples of the light-emitting patterns of the film light sources.
Figure 11B:
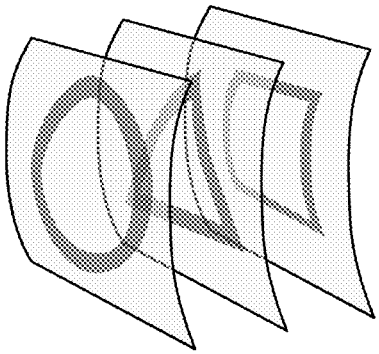

FIG. 11A and FIG. 11B are examples of the light-emitting patterns of the film light sources (semiconductor light-emitting elements 22*b*).

The light-emitting patterns of the film light sources (semiconductor light-emitting elements 22*b*) may be light-emitting patterns of which light-emitting shapes are the same and sizes thereof are different depending on the film light sources, as illustrated in FIG. 11A, or may be light-emitting patterns of which light-emitting shapes are different depending on the film light source, as illustrated in FIG. 11B. Then the perspective of depth and the three-dimensional effect can be enhanced more so.

In Embodiment 1, an example when the screws are used as the lens fixing unit 24*d* was described, but the present invention is not limited to this. For example, an engaging unit may be used as the lens fixing unit 24*d*. For example, a first claw is formed on the front lens 24*a*, a first hook and a second claw are formed on the intermediate lens 24*b*, and a second hook is formed on the rear lens 24*c* (or a first hook is formed on the front lens 24*a*, a first claw and a second hook are formed on the intermediate lens 24*b*, and a second claw is formed on the rear lens 24*c*), although these are not illustrated. Then the first claw and the first hook are engaged, and the second claw and the second hook are engaged. Thereby the front lens 24*a*, the intermediate lens 24*b* and the rear lens 24*c* may be positioned and fixed in this state.

Figure 12:
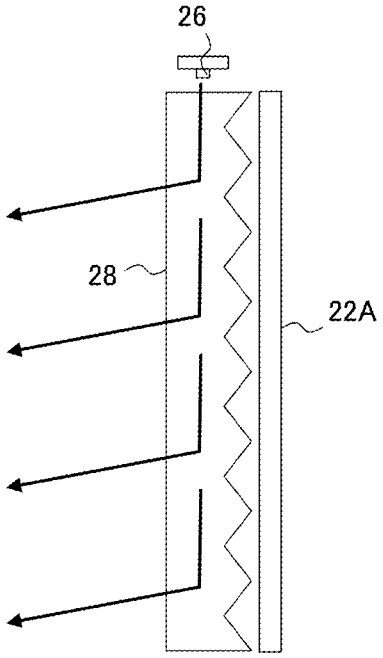
FIG. 12 is an example when the light-guiding plate 28, which guides the light from the semiconductor light-emitting elements 26 and emits the guided light from the front surface, is disposed between the front lens 24*a* and the first film light source 22A.

FIG. 12 is an example when the light-guiding plate 28, which guides the light from the semiconductor light-emitting elements 26 and emits the guided light from the front surface, is disposed between the front lens 24*a* and the first film light source 22A. On the rear surface of the light-guiding plate 28, a structure (a plurality of lens cuts, such as V-grooves) for the light from the semiconductor light-emitting elements 26, guided inside the light-guiding plate 28 to be emitted from the front surface, is formed.

Then in the case where the vehicular lamp fitting 10 functions as a tail lamp, a part or all of the respective semiconductor light-emitting elements 22*b* of the first film light source 22A and the second film light source 22B are emitted according to the first light-emitting pattern, the semiconductor light-emitting elements 26 are turned ON and the light from the semiconductor light-emitting elements 26, which is guided inside the light-guiding plate 28, is surface-emitted from the front surface. Thereby a light-emitting appearance having high design quality, where the first light-emitting pattern emerges in the surface emission, can be implemented.

The light-guiding plate 28, which guides the light from the semiconductor light-emitting elements 26 and emits the light from the front surface, may be disposed between the intermediate lens 24*b* and the second film light source 22B as well, although this is not illustrated.

Now as a modification, an example when a lamp fitting unit 20A is configured using the film light sources 22, which are not overlapped in the longitudinal direction of the vehicle, will be described.

The lamp fitting unit 20A according to this modification (not illustrated) corresponds to the lamp fitting unit 20 described in Embodiment 1, from which the first film light source 22A and the intermediate lens 24*b* are omitted. In this case, the second film light source 22B is not overlapped on the other film light sources. The rest is the same as the vehicular lamp fitting 10 described in Embodiment 1. Therefore differences from the vehicular lamp fitting 10 described in Embodiment 1 will be mainly described herein below.

A light-emitting pattern of the second film light source 22B (semiconductor light-emitting elements 22*b*) will be described.

An example of the light-emitting pattern, when the vehicular lamp fitting 10 using the lamp fitting unit 20A functions as a tail lamp, will be described first.

When the vehicular lamp fitting 10 using the lamp fitting unit 20A functions as the tail lamp, a part or all of the semiconductor light-emitting elements 22*b* of the second film light source 22B are emitted according to a third light-emitting pattern.

The third light-emitting pattern is a pattern in which the portions indicated by the black dots in FIG. 4A (semiconductor light-emitting elements 22*b*), out of the semiconductor light-emitting elements 22*b* of the second film light source 22B, emit light at a first brightness. The third light-emitting pattern is not limited to this. For example, for the third light-emitting pattern, a light-emitting pattern, in which a part of the semiconductor light-emitting elements 22*b*, out of the portions (semiconductor light-emitting elements 22*b*) indicated by the black dots in FIG. 4A, are turned OFF or dimmed, may be used. Further, for the third light-emitting pattern, a light-emitting pattern, in which brightness of the portions (semiconductor light-emitting elements 22*b*) indicated by the black dots in FIG. 4A is gradually changed, may be used. Furthermore, for the third light-emitting pattern, a light-emitting pattern, in which the brightness of each semiconductor light-emitting element 22*b* is changed, may be used. Thereby a perspective (perspective of depth) can be expressed.

The third light-emitting pattern is not limited to a static light-emitting pattern, but may be a dynamic light-emitting pattern in which brightness, light-emitting shape, light-emitting position and so forth of the portions (semiconductor light-emitting elements 22*b*) indicated by the black dots in FIG. 4A change over time.

In the case where the semiconductor light-emitting elements 22*b* of the second film light source 22B emit light according to the third light-emitting pattern, a tail lamp light distribution pattern is formed by the light Ray 1, which is emitted forward from the semiconductor light-emitting elements 22*b* of the second film light source 22B.

Further, the reflection surface 40 emits light by reflecting the light Ray 2, which is emitted backward from the semiconductor light-emitting elements 22*b* of the second film light source 22B via the film 22*a*.

As described above, when the vehicular lamp fitting 10 using the lamp fitting unit 20A functions as the tail lamp, the second film light source 22B and the reflection surface 40 emit light respectively, and the reflection surface 40, which emits light behind the second film light source 22B, is visually recognized through the second film light source 22B. Thereby a three-dimensional light-emitting appearance, having a perspective of depth, is implemented.

Also as described above, the film light source support units 24 (24*a* to 24*c*) support the second film light source 22B in the state of maintaining a predetermined shape (e.g. curved shape). Thereby the semiconductor light-emitting elements 22*b* of the second film light source 22B are three-dimensionally disposed. This also implements a three-dimensional light-emitting appearances with a perspective of depth.

The lamp fitting unit 20A is disposed in the lamp chamber 54 in the state of maintaining a space between the lamp fitting unit and the housing 52, therefore the light-emitting appearance, that is visually recognized as if the lamp fitting unit 20A were floating in the lamp chamber 54, is implemented.

An example of the light-emitting pattern when the vehicular lamp fitting 10 using a lamp fitting unit 20A functions as a stop lamp will be described next.

When the vehicular lamp fitting 10 using the lamp fitting unit 20A functions as the stop lamp, a part or all of the semiconductor light-emitting elements 22*b* of the second film light source 22B are emitted according to a fourth light-emitting pattern, which is different from the third light-emitting pattern.

The fourth light-emitting pattern is a pattern in which the portions (semiconductor light-emitting elements 22*b*) indicated by the black dots in FIG. 4B, out of the semiconductor light-emitting elements 22*b* of the second film light source 22B, emit light at a second brightness (second brightness>first brightness), for example. The fourth light-emitting pattern is not limited to this. For example, for the fourth light-emitting pattern, a light-emitting pattern, in which a part of the portions (semiconductor light-emitting elements 22*b*) indicated by the black dots in FIG. 4B, are turned OFF or dimmed, may be used. Further, for the fourth light-emitting pattern, a light-emitting pattern, in which brightness of the portions (semiconductor light-emitting elements 22*b*) indicated by the black dots in FIG. 4B, gradually changes, may be used. Furthermore, for the fourth light-emitting pattern, a light-emitting pattern, in which the brightness of each semiconductor light-emitting element 22*b* is changed, may be used. Thereby a perspective (perspective of depth) can be expressed.

The fourth light-emitting pattern is not limited to a static light-emitting pattern, but may be a dynamic light-emitting pattern in which brightness, light-emitting shape, light-emitting position and so forth of the portions (semiconductor light-emitting elements 22*b*) indicated by the black dots in FIG. 4B change over time.

In the case where the semiconductor light-emitting elements 22*b* of the second film light source 22B emit light according to the fourth light-emitting pattern, as described above, the stop lamp light distribution pattern is formed by the light Ray 1, which is emitted forward from the semiconductor light-emitting elements 22*b* of the second film light source 22B.

Further, the reflection surface 40 emits light by reflecting the light Ray 2, which is emitted backward from the semiconductor light-emitting elements 22*b* by the second film light source 22B via the film 22*a*.

As described above, when the vehicular lamp fitting 10 using the lamp fitting unit 20A functions as the stop lamp, the second film light source 22B and the reflection surface 40 emit light respectively, and the reflection surface 40, which emits light behind the second film light source 22B, are visually recognized through the second film light source 22B. Thereby a three-dimensional light-emitting appearance, having a perspective of depth, is implemented.

Also as described above, the film light source support units 24 (24*a* to 24*c*) support the second film light source 22B in the state of maintaining a predetermined shape (e.g. curved shape). Thereby the semiconductor light-emitting elements 22*b* of the second film light source 22B are three-dimensionally disposed. This also implements a three-dimensional light-emitting appearance having a perspective of depth.

The lamp fitting unit 20A is disposed in the lamp chamber 54 in the state of maintaining a space between the lamp fitting unit and the housing 52. Therefore the light-emitting appearance, that is visually recognized as if the lamp fitting unit 20A were floating in the lamp chamber 54, is implemented.

As described above, according to this modification, a slim and light lamp fitting unit 20A can be configured, where the front lens 24*a* and the rear lens 24*c* are fixed in the state of the second film light source 22B being disposed between the front lens 24*a* and the rear lens 24*c*, in addition to the effects of Embodiment 1.

According to this modification, the rear surface of the second film light source 22B and the front surface of the rear lens 24*c* are surface-contacted, therefore the shape of the second film light source 22B (film 22*a*) can be maintained in a predetermined shape (e.g. curved shape).

According to this modification, the front surface of the second film light source 22B faces the rear surface of the front lens 24*a* via a space, hence damage to the front surface of the second film light source 22B (a plurality of semiconductor light-emitting elements 22*b* mounted on the front surface), caused by contacting the rear surface of the front lens 24*a*, can be prevented.

According to this modification, the tail lamp light distribution pattern and the stop lamp light distribution pattern can be formed using one film light source (e.g. second film light source 22B).

A vehicular lamp fitting 10A according to Embodiment 2 will be described next.

Figure 13:
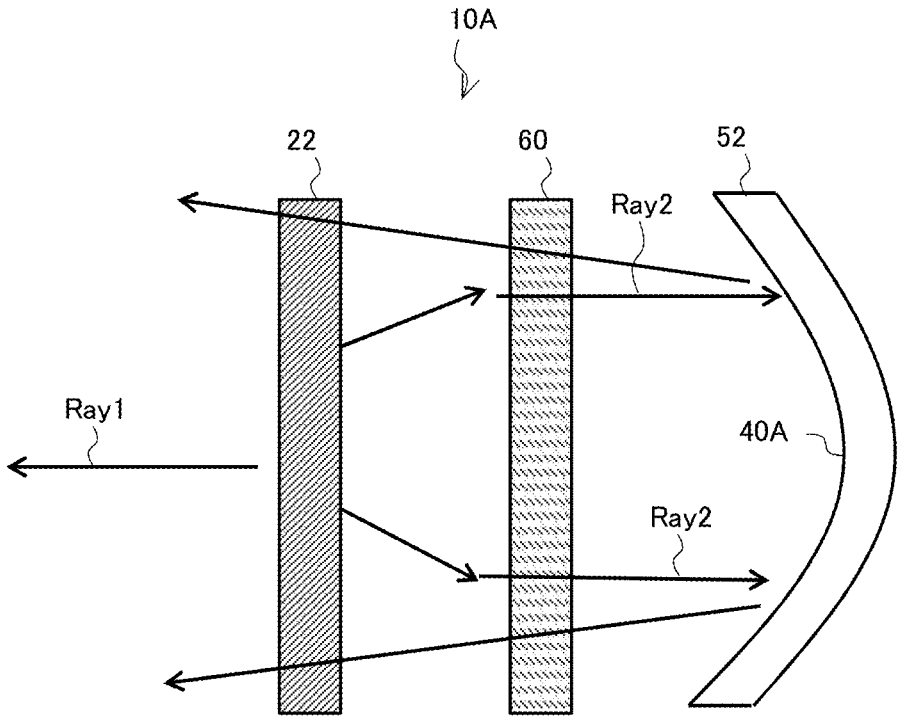
FIG. 13 is a schematic diagram (vertical cross-sectional view) of the vehicular lamp fitting 10A of Embodiment 2.
Figure 14:
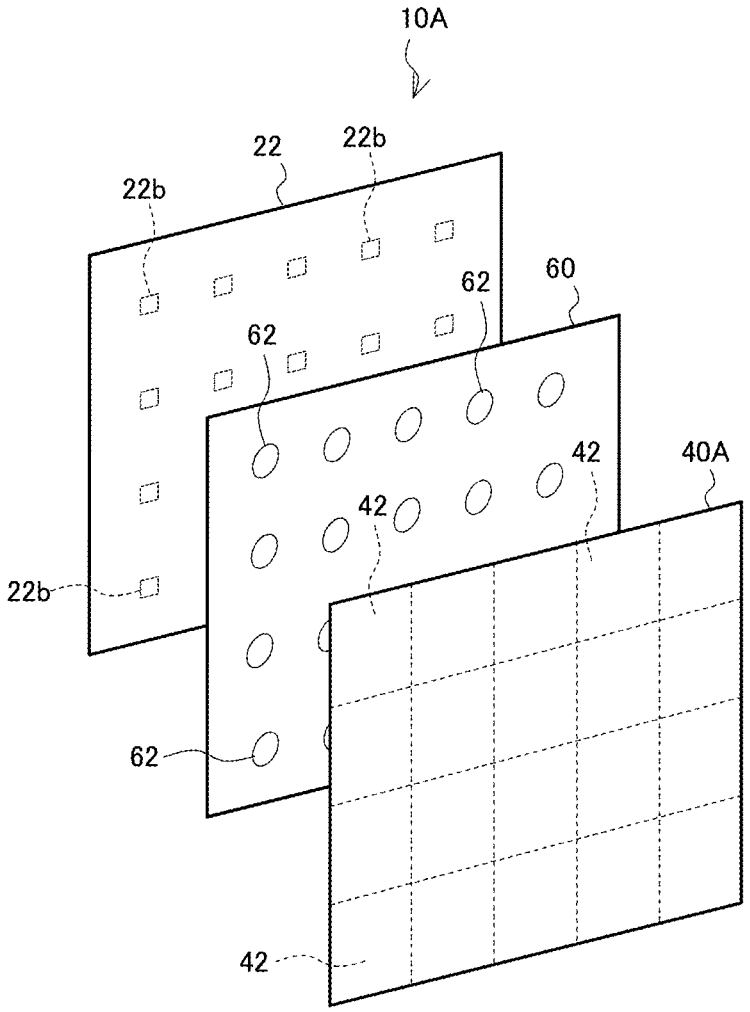
FIG. 14 is a schematic diagram (perspective view) of the vehicular lamp fitting 10A of Embodiment 2.

FIG. 13 is a schematic diagram (vertical cross-sectional view) of the vehicular lamp fitting 10A of Embodiment 2, and FIG. 14 is a schematic diagram (perspective view) of the vehicular lamp fitting 10A of Embodiment 2.

As illustrated in FIG. 13 and FIG. 14, the vehicular lamp fitting 10A of Embodiment 2 corresponds to the vehicular lamp fitting 10 described in Embodiment 1, where a light distribution control lens 60 is added and a reflection surface 40A is used instead of the reflection surface 40. The rest is the same as the vehicular lamp fitting 10 described in Embodiment 1. Differences from the vehicular lamp fitting 10 described in Embodiment 1 will be mainly described herein below. A composing element the same as the vehicular lamp fitting 10 described in Embodiment 1 is denoted with the same reference sign, and redundant description will be omitted.

A film light source 22 is a film light source including a transparent film 22*a* having flexibility, and a plurality of semiconductor light-emitting elements 22*b* which are fixed to at least the front surface of the transparent film 22*a* in a state of being disposed two-dimensionally, and is a first film light source 22A or a second film light source 22B, for example.

The light distribution control lens 60 controls the light Ray 2, which is emitted from a part or all of the semiconductor light-emitting elements 22*b* of the film light source 22, and transmitted through the transparent film 22*a*. A material of the light distribution control lens 60 is a transparent resin, such as acrylic or polycarbonate.

The light distribution control lens 60 is a plate type lens which includes a front surface and a rear surface on the opposite side of the front surface. As illustrated in FIG. 14, the light distribution control lens 60 includes a plurality of lens units 62 to which a plurality of semiconductor light-emitting elements 22*b* of the film light source 22 correspond respectively. The plurality of lens units 62 may be disposed on the front surface or on the rear surface of the light distribution control lens 60.

Each of the plurality of lens units 62 is a lens unit of which focal point is set in the vicinity of the semiconductor light-emitting element 22*b* that the lens unit 62 corresponds to, and is a Fresnel lens, for example.

Each of the plurality of lens units 62 controls the light Ray 2, which is emitted from the semiconductor light-emitting element 22*b* that a lens unit 62 corresponds to, and transmitted through the transparent film 22*a*. In concrete terms, each of the plurality of lens units 62 converts the light Ray 2, which is emitted from the semiconductor light-emitting element 22*b* that the lens unit 62 corresponds to, and transmitted through the transparent film 22*a*, into a parallel light (see FIG. 13).

As described above, the light distribution control lens 60 controls the light Ray 2, which is emitted from a part or all of the semiconductor light-emitting elements 22*b* of the film light source 22, and transmitted through the transparent film 22*a*.

The light distribution control lens 60 is disposed between the film light source 22 and the reflection surface 40A in a state where the semiconductor light-emitting elements 22*b* of the film light source 22 and the lens units 62 of the light distribution control lens 60 face each other via the film 22*a*, and the lens units 62 of the light distribution control lens 60 and the reflection regions 42 of the reflection surface 40A face each other (see FIG. 13 and FIG. 14).

The reflection surface 40A reflects the light Ray 2, which is controlled by the light distribution control lens 60 to a target direction. The reflection surface 40A is formed by depositing aluminum on the front surface of the housing 52, for example.

As illustrated in FIG. 14, the reflection surface 40A includes a plurality of reflection regions 42 to which the plurality of lens units 62 correspond respectively, for example. Each of the plurality of reflection regions 42 is a hemispherical reflection surface, which is convex or concave toward the lens unit 62 to which this reflection region 42 corresponds. The reflection surface 40A may be a free-form surface.

The light Ray 2 controlled by the lens unit 62, that is, the light Ray 2 converted into the parallel light, is diffused vertically and horizontally by the reflection regions 42, transmitted through the light distribution control lens 60 and the film light source 22, and emitted forward (see FIG. 13).

The diffusion range of the light Ray 2 reflected by the reflection regions 42 can be adjusted, for example, by adjusting the curvature of the vertical cross-section and the curvature of the horizontal cross-section of each reflection region 42. For example, the curvature of the vertical cross-section and the curvature of the horizontal cross-section of each reflection region 42 can be adjusted such that the diffusion range of the light Ray 2, reflected by the reflection regions 42, is contained within the range of the tail lamp light distribution pattern or the stop lamp light distribution pattern.

As described above, the light Ray 2 controlled by the light distribution control lens 60 is reflected to the target direction.

The light distribution control lens 60 and the reflection surface 40A having the above configuration can be applied to various vehicular lamp fittings using the film light source 22.

For example, the light distribution control lens 60 and the reflection surface 40A having the above configuration can be applied to the vehicular lamp fitting 10 of Embodiment 1 (the vehicular lamp fitting 10 using the two film light sources 22, which are overlapped in the longitudinal direction of the vehicle). Hereafter the vehicular lamp fitting 10 of Embodiment 1, to which the light distribution control lens 60 and the reflection surface 40A are applied, is called the vehicular lamp fitting 10A1.

Figure 15:
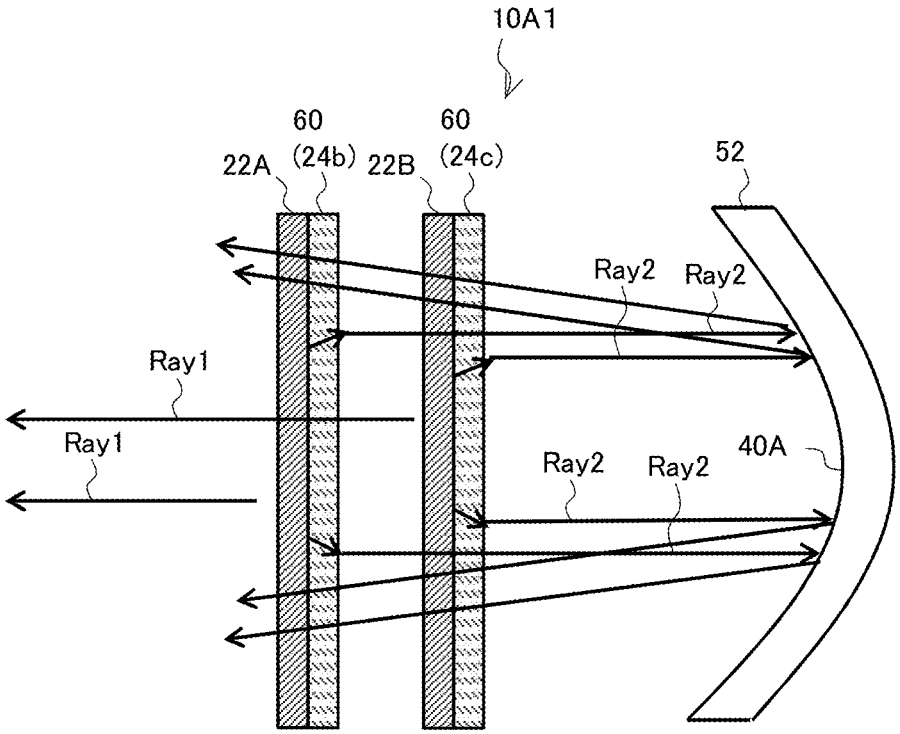
FIG. 15 is an example (schematic diagram) of the vehicular lamp fitting 10A1.

FIG. 15 is an example (schematic diagram) of the vehicular lamp fitting 10A1. In FIG. 15, the outer lens 50 and the front lens 24*a* are omitted.

In FIG. 15, the intermediate lens 24*b* and the rear lens 24*c* are configured as the light distribution control lenses 60 respectively. In other words, the intermediate lens 24*b* and the rear lens 24*c* function as the light distribution control lenses 60 respectively.

Figure 16:
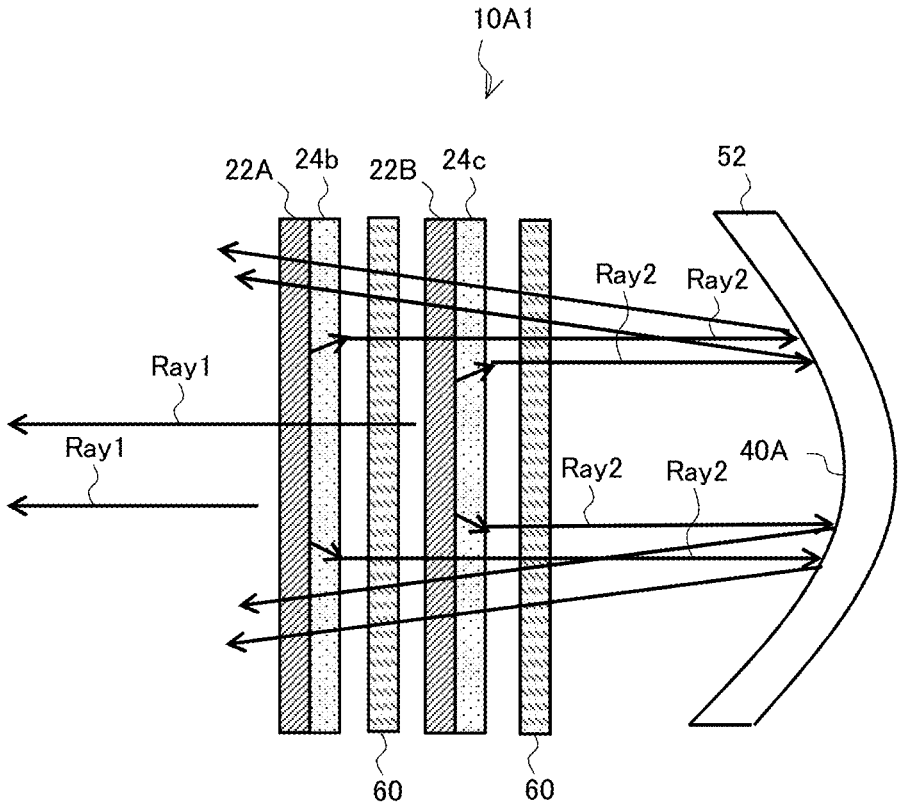
FIG. 16 is another example (schematic diagram) of the vehicular lamp fitting 10A1.

FIG. 16 is another example (schematic diagram) of the vehicular lamp fitting 10A1. In FIG. 16, the outer lens 50 and the front lens 24*a* are omitted.

In FIG. 16, the light distribution control lenses 60 are respectively disposed between the intermediate lens 24*b* and the second film light source 22B, and between the rear lens 24*c* and the reflection surface 40A.

According to the vehicular lamp fitting 10A1, in addition to the effect of Embodiment 1, the light utilization efficiency of the light Ray 2, which is emitted backward from the semiconductor light-emitting elements 22*b* of the first and second film light sources 22A and 22B, improves.

In other words, as illustrated in FIG. 15 and FIG. 16, when the vehicular lamp fitting 10A1 functions as a tail lamp, the tail lamp light distribution pattern can be formed by not only the light Ray 1, which is radiated (emitted) forward from the first and second film light sources 22A and 22B, but also by reflecting the light Ray 2 radiated (emitted) backward from the first and second film light sources 22A and 22B respectively to target directions using the reflection surface 40A. In concrete terms, the tail lamp light distribution pattern can be formed by the light Ray 2, which is radiated (emitted) backward from the first and second film light sources 22A and 22B respectively, is controlled by the light distribution control lens 60, is reflected by the reflection surface 40A, and transmitted through the light distribution control lens 60 and the first and second film light sources 22A and 22B. This is also the same when the vehicular lamp fitting 10A1 functions as a stop lamp.

Further, the light distribution control lens 60 and the reflection surface 40A having the above configuration may be applied to the vehicular lamp fitting 10 of the modification of Embodiment 1 (the vehicular lamp fitting 10 using the film light sources 22, which are not overlapped in the longitudinal direction of the vehicle). Hereafter the vehicular lamp fitting 10 of the modification of Embodiment 1, to which the light distribution control lens 60 and the reflection surface 40A are applied, is called the vehicular lamp fitting 10A2.

Figure 17:
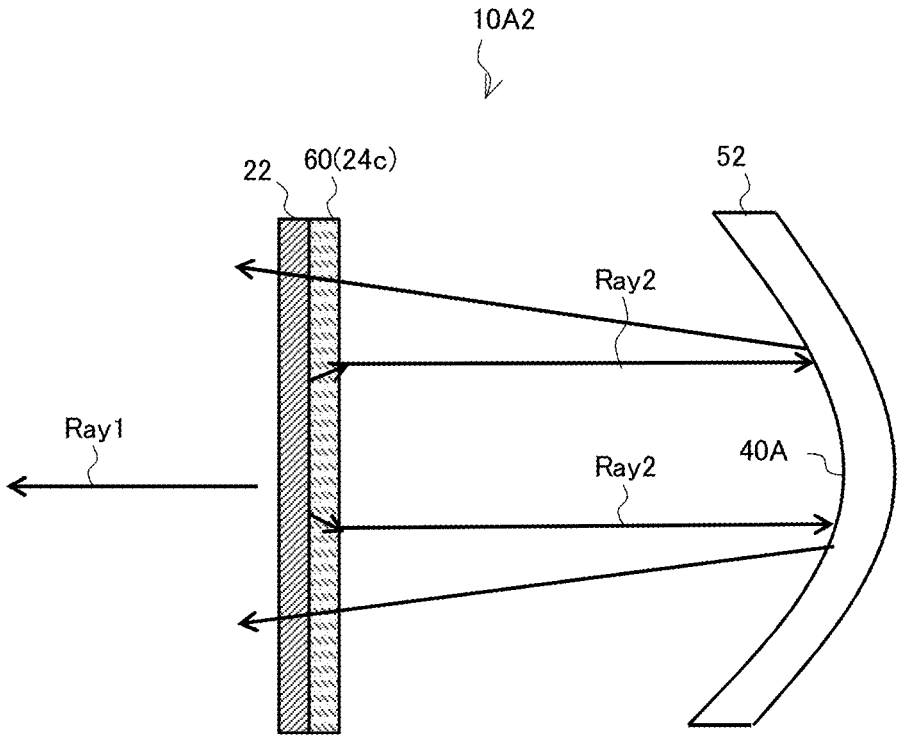
FIG. 17 is an example (schematic diagram) of the vehicular lamp fitting 10A2.

FIG. 17 is an example (schematic diagram) of the vehicular lamp fitting 10A2. In FIG. 17, the outer lens 50 and the front lens 24*a* are omitted.

In FIG. 17, the rear lens 24*c* is configured as the light distribution control lens 60. In other words, the rear lens 24*c* also functions as the light distribution control lens 60.

Figure 18:
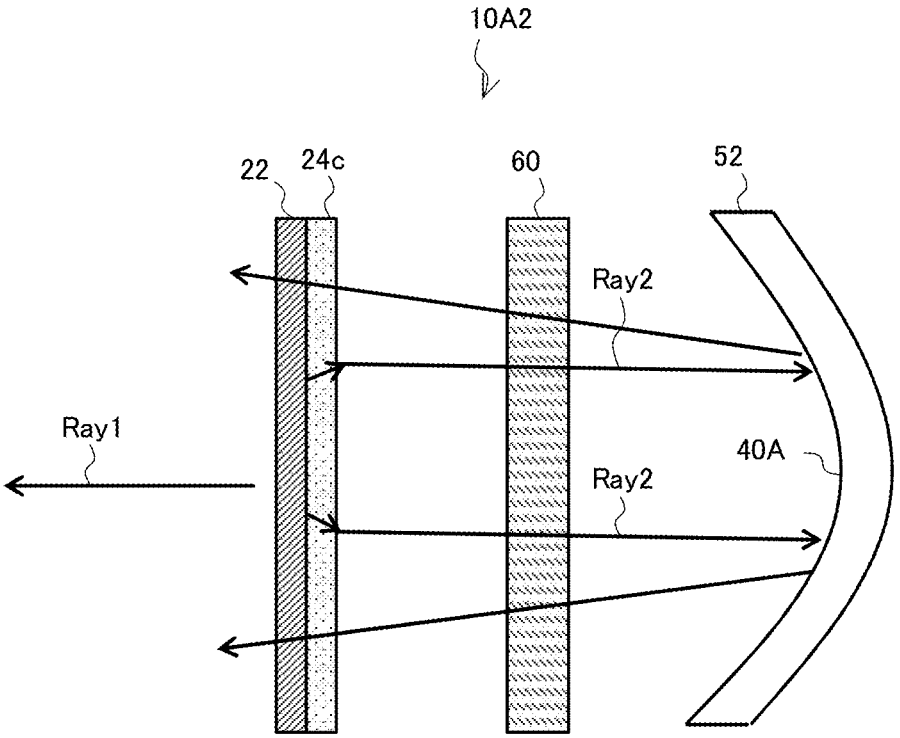
FIG. 18 is another example (schematic diagram) of the vehicular lamp fitting 10A2.

FIG. 18 is another example (schematic diagram) of the vehicular lamp fitting 10A2. In FIG. 18, the outer lens 50 and the front lens 24*a* are omitted.

In FIG. 18, the light distribution control lens 60 is disposed between the rear lens 24*c* and the reflection surface 40A.

According to the vehicular lamp fitting 10A2, in addition to the effect of Embodiment 1, the light utilization efficiency of the light Ray 2, which is emitted backward from the semiconductor light-emitting elements 22*b* of the film light source 22 (e.g. second film light source 22B), improves.

In other words, as illustrated in FIG. 17 and FIG. 18, when the vehicular lamp fitting 10A2 functions as a tail lamp, the tail lamp light distribution pattern can be formed by not only the light Ray 1, which is radiated (emitted) forward from the film light source 22, but also by reflecting the light Ray 2 radiated (emitted) backward from the film light source 22 to the target directions using the reflection surface 40A. In concrete terms, the tail lamp light distribution pattern can be formed by the light Ray 2, which is radiated (emitted) backward from the film light source 22, is controlled by the light distribution control lens 60, is reflected by the reflection surface 40A, and transmitted through the light distribution control lens 60 and the film light source 22. This is also the same when the vehicular lamp fitting 10A2 functions as a stop lamp.

As described above, according to Embodiment 2, in addition to the effect of Embodiment 1, the light utilization efficiency of the light Ray 2, which is emitted backward from the semiconductor light-emitting elements 22*b* of the film light source 22, improves. In other words, a predetermined light distribution pattern (e.g. tail lamp light distribution pattern, stop lamp light distribution pattern) can be formed by not only the light Ray 1, which is radiated (emitted) forward from the film light source 22, but also by reflecting the light Ray 2, which is radiated (emitted) backward from the film light source 22 to the target directions using the reflection surface 40A.

A modification will be described next.

In Embodiment 2, an example when a Fresnel lens is used for the lens unit 62 of the light distribution control lens 60 was described, but the present invention is not limited to this. For example, a flute cut or other lens cut may be used for the lens unit 62 of the light distribution control lens 60.

A vehicular lamp fitting 10B according to Embodiment 3 will be described next.

Figure 19:
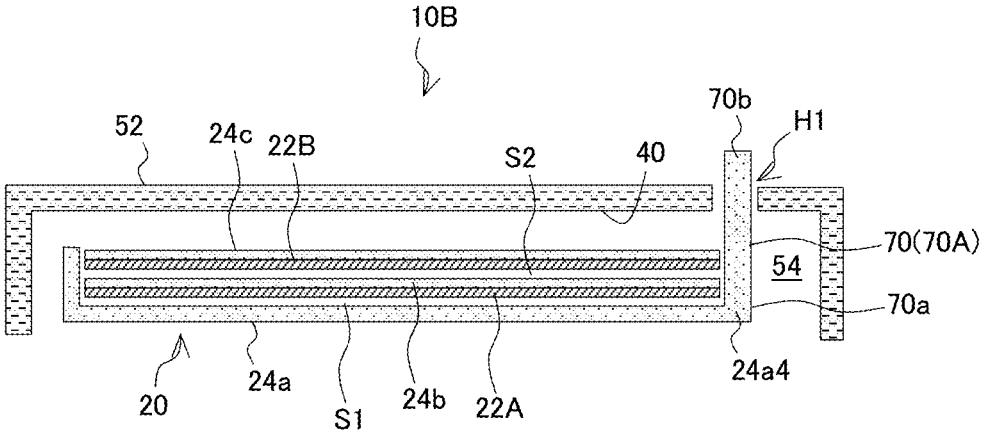
FIG. 19 is a schematic diagram (horizontal cross-sectional view) of the vehicular lamp fitting 10B of Embodiment 3.

FIG. 19 is a schematic diagram (horizontal cross-sectional view) of the vehicular lamp fitting 10B of Embodiment 3. In FIG. 19, the outer lens 50 is omitted.

As illustrated in FIG. 19, the vehicular lamp fitting 10B of Embodiment 3 corresponds to the vehicular lamp fitting 10 described in Embodiment 1, where a lamp fitting unit support unit 70 is used instead of the lamp fitting unit support unit (each flange unit 24*a*2 to 24*c*2). The rest is the same as the vehicular lamp fitting 10 described in Embodiment 1. Differences from the vehicular lamp fitting 10 described in Embodiment 1 will be mainly described herein below. A composing element the same as the vehicular lamp fitting 10 described in Embodiment 1 is denoted with the same reference sign, and redundant description will be omitted.

The lamp fitting unit support unit 70 supports the lamp fitting unit 20 in a lamp chamber 54 constituted by a housing 52 and an outer lens 50, in a state of maintaining a space between the lamp fitting unit and the housing 52.

For example, as illustrated in FIG. 19, the lamp fitting unit support unit 70 is a transparent support unit 70A of which base end portion 70*a* (corresponds to "a part" in the present invention) is fixed to the lamp fitting unit 20 (e.g. front lens 24*a*), and of which front end portion 70*b* (corresponds to "another part" in the present invention) is fixed to the housing 52.

The transparent support unit 70A extends backward from the base end portion 70*a*, which is fixed to one end 24*a*4 of the front lens 24*a*, and supports the lamp fitting unit 20 in the lamp chamber 54 in a state of maintaining a space between the lamp fitting unit and the housing 52 (cantilever support) by fixing the front end portion 70*b* to the housing 52. The transparent support unit 70A is fixed to the housing 52 by the front end portion 70*b* thereof, fitting to or engaged with an opening H1 formed in the housing 52, for example. A material of the transparent support unit 70A is a transparent resin, such as acrylic or polycarbonate.

The lamp fitting unit support unit 70 having the above configuration is applicable to various vehicular lamp fitting using the film light source 22. For example, the lamp fitting unit support unit 70 can be applied to the vehicular lamp fitting 10 of Embodiment 1 (vehicular lamp fitting 10 using the two film light sources 22, which are overlapped in the longitudinal direction of the vehicle), the vehicular lamp fitting 10 of the modification of Embodiment 1 (vehicular lap fitting 10 using the film light sources 22, which are not overlapped in the longitudinal direction of the vehicle), or the vehicular lamp fitting 10A of Embodiment 2 (vehicular lamp fitting 10 using the light distribution control lens 60 and the reflection surface 40A).

As described above, according to Embodiment 3, the following effects can be further implemented in addition to the effect of Embodiment 1. That is, when the vehicular lamp fitting 10B functions as a tail lamp, the lamp fitting unit 20 is disposed in the lamp chamber 54 in a state of maintaining a space between the lamp fitting unit and the housing 52, and the lamp fitting unit support unit 70 is transparent and is not visually recognized very much, therefore a light-emitting appearance, that is visually recognized as if the lamp fitting unit 20 were floating in the lamp chamber 54, is implemented.

Modifications will be described next.

Figure 20:
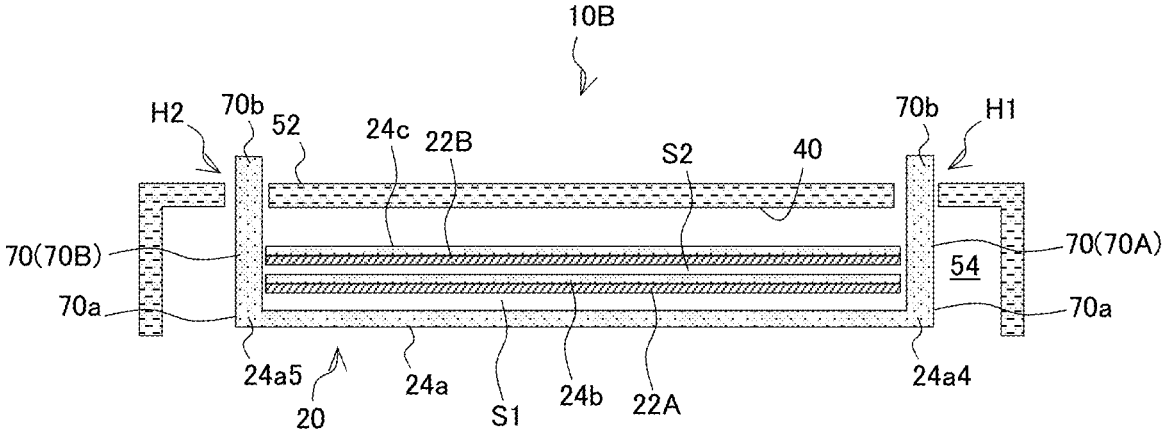
FIG. 20 is a schematic diagram (horizontal cross-sectional view) of the vehicular lamp fitting 10B of Embodiment 3.

FIG. 20 is a schematic diagram (horizontal cross-sectional view) of the vehicular lamp fitting 10B of Embodiment 3.

In Embodiment 3, an example of the lamp fitting unit support unit 70 using the transparent support unit 70A, which extends backward from the base end portion 70*a*, which is fixed to one end portion 24*a*4 of the front lens 24*a*, and of which front end portion 70*b* is fixed to the housing 52, was described, but the present invention is not limited to this. For example, as illustrated in FIG. 20, the lamp fitting unit support unit 70 using a transparent support unit 70B, which extends backward from the base end portion 70*a*, which is fixed to the other end portion 24*a*5 of the front lens 24*a*, and of which front end portion 70*b* is fixed to the housing 52, may be used in addition to the transparent support unit 70A.

In Embodiment 3, an example of the base end portion 70*a* of the transparent support unit 70A (70B), which is fixed to the front lens 24*a*, was described, but the present invention is not limited to this. In other words, the base end portion 70*a* of the transparent support unit 70A (70B) may be fixed to other parts of the lamp fitting unit 20. For example, the base end portion 70*a* of the transparent support unit 70A (70B) may be fixed to the intermediate lens 24*b*, or to the rear lens 24*c*.

The numeric values used for each of the above embodiments are all examples, and needless to say, other appropriate numeric values may be used.

Each of the above embodiments are examples in all aspects. It should be understood that the present invention is not limited to the description of the embodiments. The present invention can be carried out in various forms, within the scope of the spirit or major characteristics of the invention.

What is claimed is:

1. A vehicular lamp fitting comprising:

a film light source that includes a transparent film having flexibility, and a plurality of semiconductor light-emitting elements which are fixed in a state of being two-dimensionally disposed on at least a front surface of the transparent film; and a reflection surface that is disposed in a state of facing a rear surface of the transparent film of the film light source, and that reflects light which is emitted from a part or all of the plurality of semiconductor light-emitting elements and transmitted through the transparent film; and a light distribution control lens that controls light which is emitted from a part or all of the plurality of semiconductor light-emitting elements and transmitted through the transparent film, wherein the light distribution control lens is disposed between the film light source and the reflection surface, the reflection surface reflects the light controlled by the light distribution control lens, and the light distribution control lens includes a plurality of lens units respectively corresponding to the plurality of semiconductor light-emitting elements and each controlling the light which is emitted from the semiconductor light-emitting element corresponding to the lens unit and transmitted through the transparent film.

2. The vehicular lamp fitting according to claim 1, wherein each of the plurality of lens units is a flute cut lens.

3. The vehicular lamp fitting according to claim 1, wherein each of the plurality of lens units is a lens unit of which focal point is set in the vicinity of the semiconductor light-emitting element corresponding to the lens unit, wherein the reflection surface reflects the light controlled by each of the plurality of lens units to a target direction.

4. The vehicular lamp fitting according to claim 1, wherein each of the plurality of lens units is a Fresnel lens.

5. The vehicular lamp fitting according to claim 1, further comprising a film light source support unit that supports the film light source in a state of the transparent film maintaining a predetermined shape, wherein the film light source support unit includes a front lens, a rear lens, and a lens fixing unit that fixes the front lens and the rear lens, wherein the lens fixing unit fixes the front lens and the rear lens in a state of the film light source being disposed between the front lens and the rear lens.

6. The vehicular lamp fitting according to claim 5, wherein the rear lens is configured as the light distribution control lens.

7. The vehicular lamp fitting according to claim 5, wherein the light distribution control lens is disposed between the rear lens and the reflection surface.

8. The vehicular lamp fitting according to claim 1, further comprising:

a film light source support unit that supports the film light source in a state of the transparent film maintaining a predetermined shape; and a plurality of the film light sources, wherein the plurality of film light sources are disposed in a state of being overlapped in a longitudinal direction of the vehicle within a same range in a front view, wherein the plurality of film light sources include at least a first film light source and a second film light source, wherein the film light source support unit includes a front lens, an intermediate lens, a rear lens and a lens fixing unit which fixes the front lens, the intermediate lens and the rear lens, wherein the lens fixing unit fixes the front lens, the intermediate lens and the rear lens in a state where the first film light source is disposed between the front lens and the intermediate lens, and the second film light source is disposed between the intermediate lens and the rear lens.

9. The vehicular lamp fitting according to claim 8, wherein the intermediate lens and the rear lens are each configured as the light distribution control lens.

10. The vehicular lamp fitting according to claim 8, wherein the vehicular lamp fitting comprises the light distribution control lenses respectively disposed between the intermediate lens and the second film light source, and between the rear lens and the reflection surface.

11. The vehicular lamp fitting according to claim 1, further comprising:

a film light source support unit that supports the film light source in a state of the transparent film maintaining a predetermined shape;

a lamp fitting unit that includes the film light source and the film light source support unit; and a lamp fitting unit support unit that is transparent and supports the lamp fitting unit, wherein the lamp fitting unit support unit supports the lamp fitting unit in a lamp chamber constituted of a housing and an outer lens in a state of maintaining a space between the lamp fitting unit and the housing.

12. The vehicular lamp fitting according to claim 11, wherein the lamp fitting unit support unit is a transparent support unit of which a part is fixed to the lamp fitting unit and another part is fixed to the housing.

13. The vehicular lamp fitting according to claim 12, wherein the lamp fitting unit is cantilever-supported by the transparent support unit.

14. The vehicular lamp fitting according to claim 1, further comprising:

a plurality of the film light sources, wherein the plurality of film light sources are disposed in a state of being overlapped in a longitudinal direction of the vehicle within a same range in a front view.

15. The vehicular lamp fitting according to claim 14, wherein the semiconductor light-emitting elements of each of the plurality of film light sources are arranged in a state of not overlapping with the semiconductor light-emitting elements of the other film light sources and overlapping with the film portions of the other film light sources in a front view.

* * * * *